US007278879B2

(12) United States Patent
Kim et al.

(10) Patent No.: US 7,278,879 B2
(45) Date of Patent: Oct. 9, 2007

(54) CONNECTOR ISOLATION STATION SYSTEM

(75) Inventors: Frank Chin-Hwan Kim, Woodinville, WA (US); Jeffrey P. Seefried, Lake Stevens, WA (US); John Redfield, Brier, WA (US); Darrell W. Zielke, Bothell, WA (US); Patrick S. McNutt, Carnation, WA (US); Phillip Phung, Kirkland, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/361,845

(22) Filed: Feb. 23, 2006

(65) Prior Publication Data

US 2007/0032129 A1 Feb. 8, 2007

Related U.S. Application Data

(60) Provisional application No. 60/705,414, filed on Aug. 3, 2005.

(51) Int. Cl.
*H01R 13/60* (2006.01)
*H01R 13/66* (2006.01)

(52) U.S. Cl. ..... 439/540.1

(58) Field of Classification Search ..... 439/540.1, 439/676, 527; 361/727; 385/53
See application file for complete search history.

(56) References Cited

U.S. PATENT DOCUMENTS

| | | | | |
|---|---|---|---|---|
| 6,217,226 | B1 * | 4/2001 | Gibbs et al. | 385/53 |
| 6,231,380 | B1 * | 5/2001 | Cabalka et al. | 439/540.1 |
| 6,412,986 | B1 * | 7/2002 | Ngo et al. | 385/53 |
| 6,468,089 | B1 * | 10/2002 | Hubbard et al. | 439/63 |
| 7,005,996 | B2 * | 2/2006 | Cabrera et al. | 340/639 |
| 7,052,315 | B2 * | 5/2006 | Murr et al. | 439/540.1 |
| 7,112,090 | B2 * | 9/2006 | Caveney et al. | 439/540.1 |
| 7,207,846 | B2 * | 4/2007 | Caveney et al. | 439/676 |
| 2005/0159036 | A1 * | 7/2005 | Caveney et al. | 439/188 |
| 2005/0186838 | A1 * | 8/2005 | Debenedictis et al. | 439/540.1 |
| 2006/0128212 | A1 * | 6/2006 | Carrick | 439/540.1 |

* cited by examiner

*Primary Examiner*—Michael C. Zarroli
(74) *Attorney, Agent, or Firm*—Brian L. Johnson; George C. Rondeau, Jr.; Davis Wright Tremaine LLP

(57) ABSTRACT

A connector isolation station system includes ports to receive connectors and includes shield members. The shield members have material properties to substantially shield, attenuate, absorb, diminish, or otherwise hinder or at least partially block wireless signals and noise from impinging upon or otherwise interfering with signal transmissions occurring through the connectors located in the connector isolation station. For instance, transmissions through adjacent connectors are substantially prevented from interfering with one another.

21 Claims, 26 Drawing Sheets

CONNECTOR ISOLATION STATION SYSTEM

BACKGROUND OF THE INVENTION

1. Field of the Invention

The present invention is generally related to connector stations.

2. Description of the Related Art

Connectors are generally used in connector stations or in other applications to interface with cables and wires used in signal transmission including data, video, and/or audio transmissions. A connector can be typically located with multiple other connectors and/or in otherwise noisy environments from a signal transmission standpoint. With conventional approaches, when connectors are used for relatively high-speed transmissions, noise due to close proximity of other connectors or due to other environmental factors can interfere to the point that high-speed or other transmissions cannot be achieved or maintained.

BRIEF DESCRIPTION OF THE SEVERAL VIEWS OF THE DRAWING(S)

DETAILED DESCRIPTION OF THE INVENTION

Figure 1:
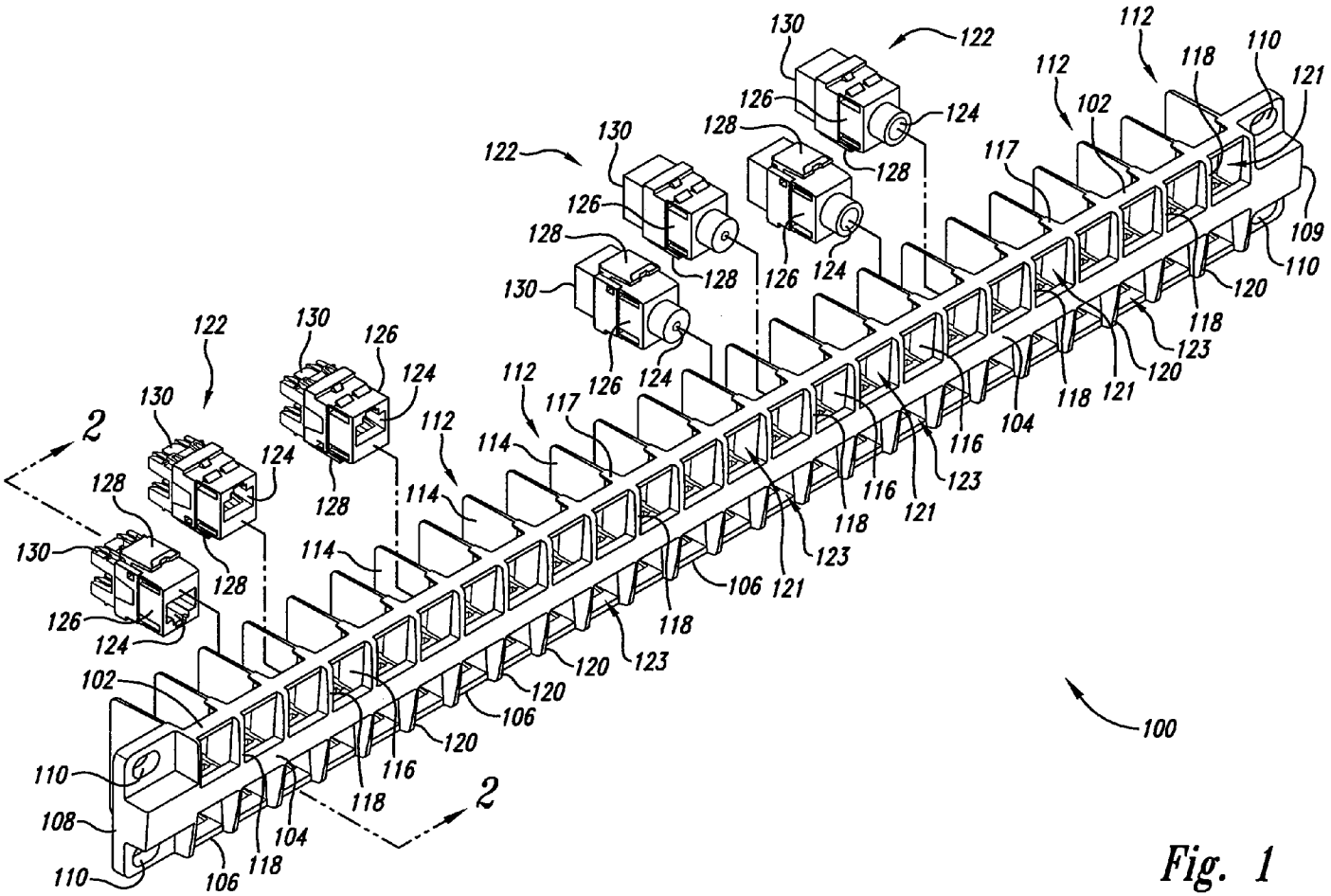
FIG. 1 is a front isometric view of a first implementation of a connector isolation station and several connectors to be received by the station.

As discussed herein, a connector isolation station system affords protection of transmissions through individual connectors from interference caused by transmissions through other individual connectors in close proximity therewith and/or from interference due to other environmental factors. The connector isolation station is particularly helpful in situations where relatively high-speed transmissions are involved. Protection from interference allows for high-speed transmissions through the individual connectors whereas without such protection such high-speed transmissions may not be achieved or maintained.

A first implementation 100 of the connector isolation station in the form of a patch panel is shown in FIGS. 1-9 as having a first longitudinal member 102, a second longitudinal member 104, and a third longitudinal member 106 extending between a first bracket 108 and a second bracket 109. The first implementation 100 is described first herein, with other implementations described subsequently. The subsequently described implementations may also include common aspects as described of the first implementation 100, but for sake of readability will not be repeated when the subsequently described implementations are discussed below.

In the first implementation 100, the second longitudinal member 104 serves as a center of an I-beam construction with the first longitudinal member 102 and the third longitudinal member 106 acting as the external flange members of the I-beam to provide additional structural integrity. Other implementations have various other shapes for structural members, including non-parallel oriented members, while staying within the scope and intent of the implementations depicted. In the first implementation 100, the first bracket 108 and the second bracket 109 have holes 110 for mounting purposes as further described below.

Extending from the first longitudinal member 102, the second longitudinal member 104, and the third longitudinal member 106 are a plurality of longitudinally spaced apart shield plates or members 112. The shield members 112 are depicted as vertically oriented, relatively flat walls, however, as shown below with other implementations and as presently described herein, other implementations of the shield members include various other shaped surfaces and orientations. Each of the shield members 112 of the first implementation 100 includes a rear shield portion 114 and a front shield portion 116.

The first longitudinal member 102 and the third longitudinal member 106 have upper and lower reinforcement portions 117 from which the front shield portions 116 of the shield members 112 extend and to which they are attached. The front shield portions 116 are also attached to the second longitudinal member 104. First front frame portions 118 extend between and are attached to the first longitudinal member 102 and the second longitudinal member 104. Second front frame portions 120 extend between and are attached to the second longitudinal member 104 and the third longitudinal member 106. The front shield portions 116 also extend from and are attached to the first front frame portions 118 and the second front frame portions 120.

The first longitudinal member 102 and the second longitudinal member 104 on the top and bottom, and the first front frame portions 118 on the sides define upper connector receptacles or ports 121 arranged in a longitudinally extending upper row within which connectors 122 may be positioned. The second longitudinal member 104 and the third longitudinal member 106 on the top and bottom, and the second front frame portions 120 on the sides define lower connector receptacles or ports 123 arranged in a longitudinally extending lower row within which connectors 122 may be positioned. The row of lower ports 123 is positioned below the row of upper ports 121, and the upper and lower ports 121 and 123 of the upper and lower rows are aligned in vertically aligned pairs, one above the other. The shield members 112 are positioned to be between connectors in laterally adjacent upper ports 121 of the upper row and laterally adjacent lower ports 123 of the lower row.

The rear shield portions 114 of the shield members 112 extend from and are attached to the corresponding front shield portions 116. The shield members 112, the first longitudinal member 102, the second longitudinal member 104, the third longitudinal member 106, and other portions of the first implementation 100 that may be involved with isolation of the connectors 122 positioned within the upper and lower ports 121 and 123 have material properties to substantially shield, attenuate, absorb, diminish, or otherwise hinder or at least partially block wireless signals and noise from impinging upon or otherwise interfering with signal transmissions through the connectors. Wireless signals and noise is used broadly to include electromagnetic energy and electrical signals and noise that may be propagating in the vicinity of one of a plurality of connectors 122 retained by the first implementation 100 as further described below.

An example of wireless signals and noise would be that emanating from one of the connectors 122 being retained within one of the upper or lower ports 121 or 123 by the first implementation 100 that would otherwise interfere with transmissions with a laterally adjacent connector. Such material properties can include having a certain degree of electrical conductivity such as found with metals or semi-metallic materials (for instance, and aluminum or zinc alloy), conductive plastic, or non-conductive structural material (such as plastic) coated with a conductive material. Structural material can be die cast or be malleable with embedded conductive properties. Those portions of the structural members of the first implementation 100 that are conductive may also be used for electrical grounding of equipment as conditions permit.

The rear shield portion 114 is thinner than the front shield portion 116 thereby allowing more room to initially receive the connectors 122 between the shield members 112. The greater thickness of the front shield portions 116 provides a more snug fit of the connectors 122 within the upper and lower ports 121 and 123 of the first implementation 100 of the connector isolation station. The first implementation 100 is depicted as being able to contain up to 48 of the connectors 122 in a relatively high connector density configuration. As discussed below, depicted and other implementations of the connector isolation station are configured to contain the connectors 122 in high, medium, and low-density connector configurations.

Each of the connectors 122 has a connector receptacle portion 124, a front connector portion 126, a connector catch 128, and a rear connector portion 130. The receptacle portion 124 will vary depending on the type of cabling and/or wiring that each of the connectors 122 will interface with, such as RJ-45, RJ-11, S-Video, 10G, Cat 6, Cat 6+, RCA, or other conventional types. The connectors 122 may also include fiber optic type connectors that could be retained along with other connectors in the upper and lower ports 121 and 123 of the first implementation 100. The connector catch 128 is used for securing the connector 122 within the upper or lower port 121 or 123 within which inserted, as described further below. The rear connector portion 130 will also vary according to the type of cabling or wiring to be interfaced. The connectors 122 depicted are of a snap-in type such as conventional QuickPort(TM), Keystone(TM), or other snap-in type. In other implementations, the connectors 122 can also be of something other than a snap-in type and thus not include the connector catch 128.

Figure 2:
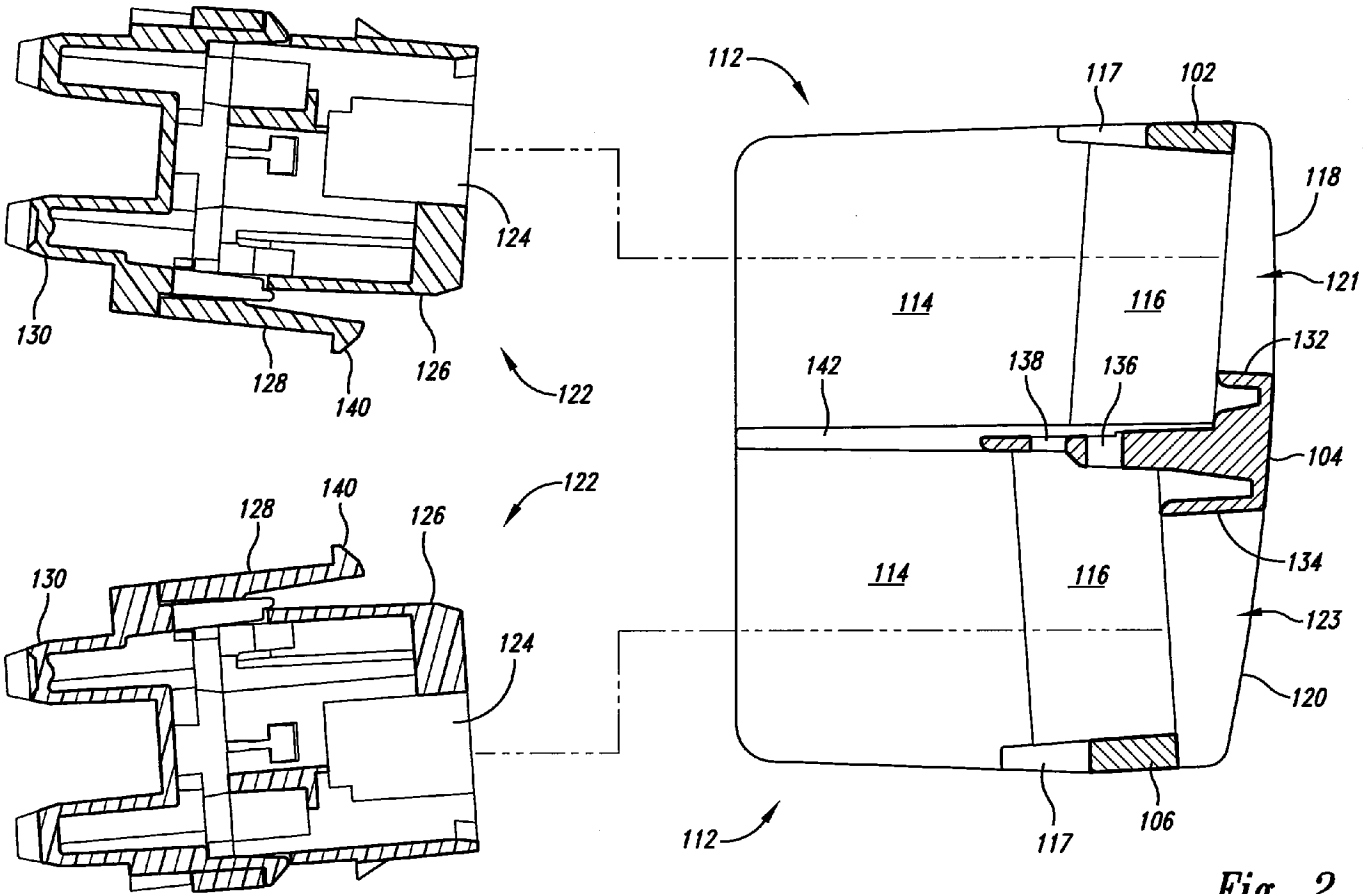
FIG. 2 is an enlarged cross-sectional view taken substantially along the line 2-2 of FIG. 1 showing two connectors to be received by the station.

Between each pair of adjacent shield members 112, the second longitudinal member 104 includes a first stop 132, a second stop 134, a first hold 136, and a second hold 138, as shown in FIG. 2. The catch 128 of the connector 122 further includes a barb 140. The first hold 136 is shaped and positioned to releasable receive the barb 140 of the catch 128 of the connector 122 inserted into the upper port 121 of the upper row of ports to engage the connector with the first implementation 100. The second hold 138 is shaped and positioned to releasable receive the barb 140 of the catch 128 of the connector 122 inserted into the lower port 123 of the lower row of ports to engage the connector with the first implementation.

Figure 3:
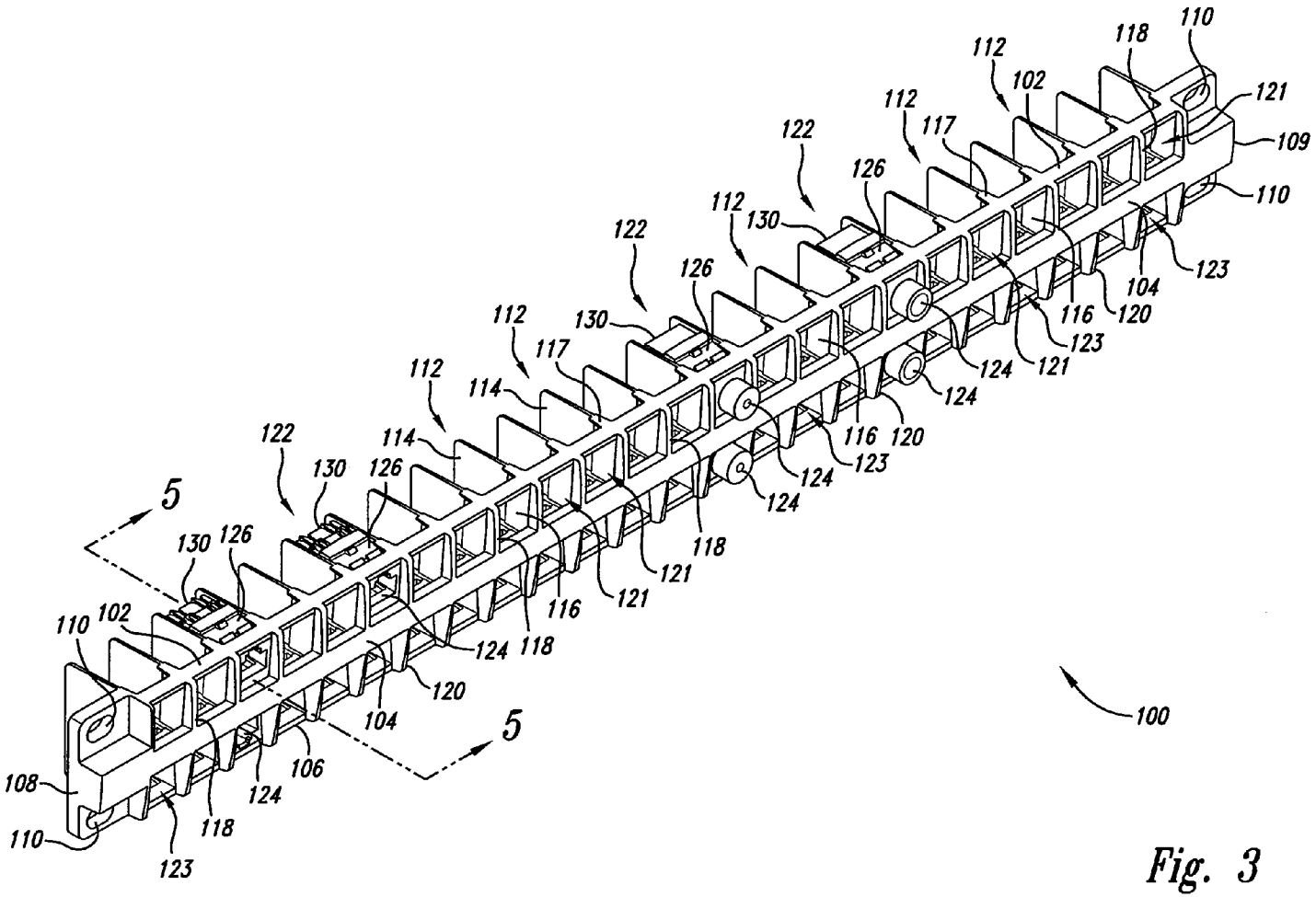
FIG. 3 is a front isometric view of the first implementation of FIG. 1 with several connectors received by the station.
Figure 4:
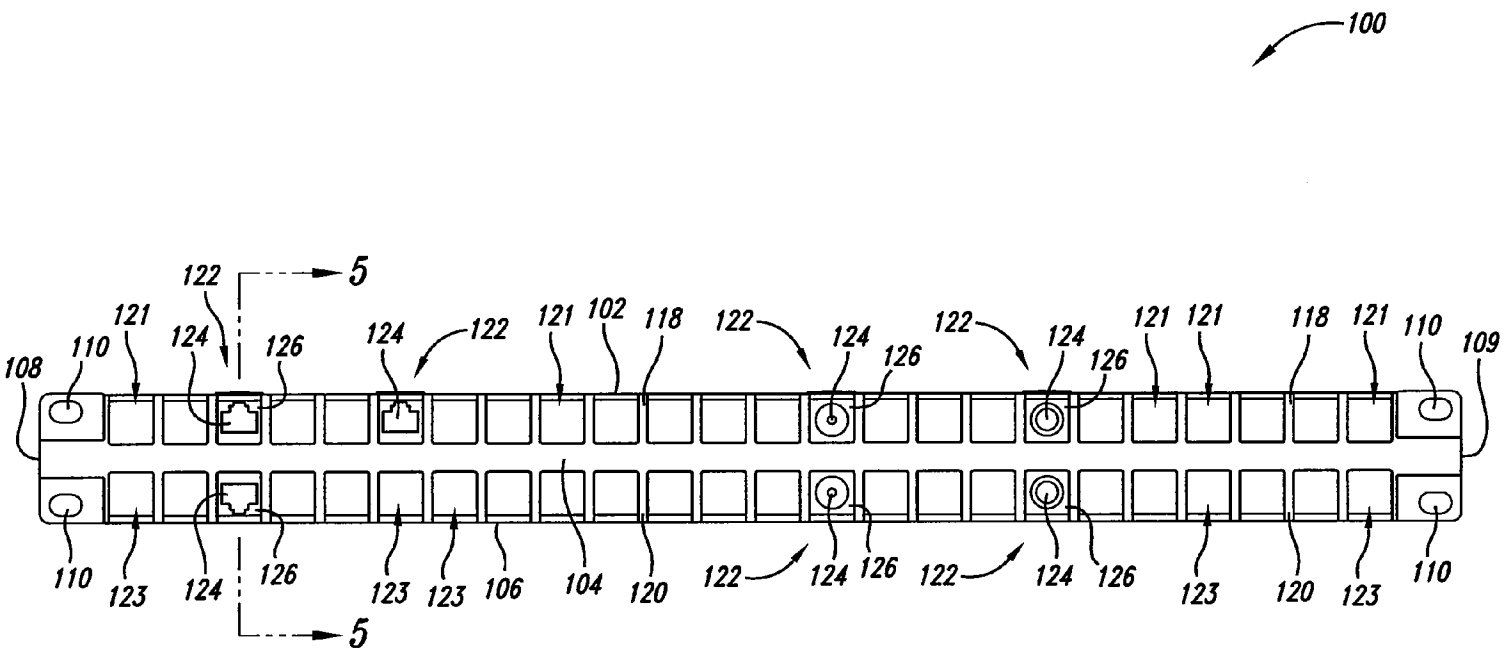
FIG. 4 is a front elevational view of the first implementation of FIG. 1 with several connectors received by the station.
Figure 5:
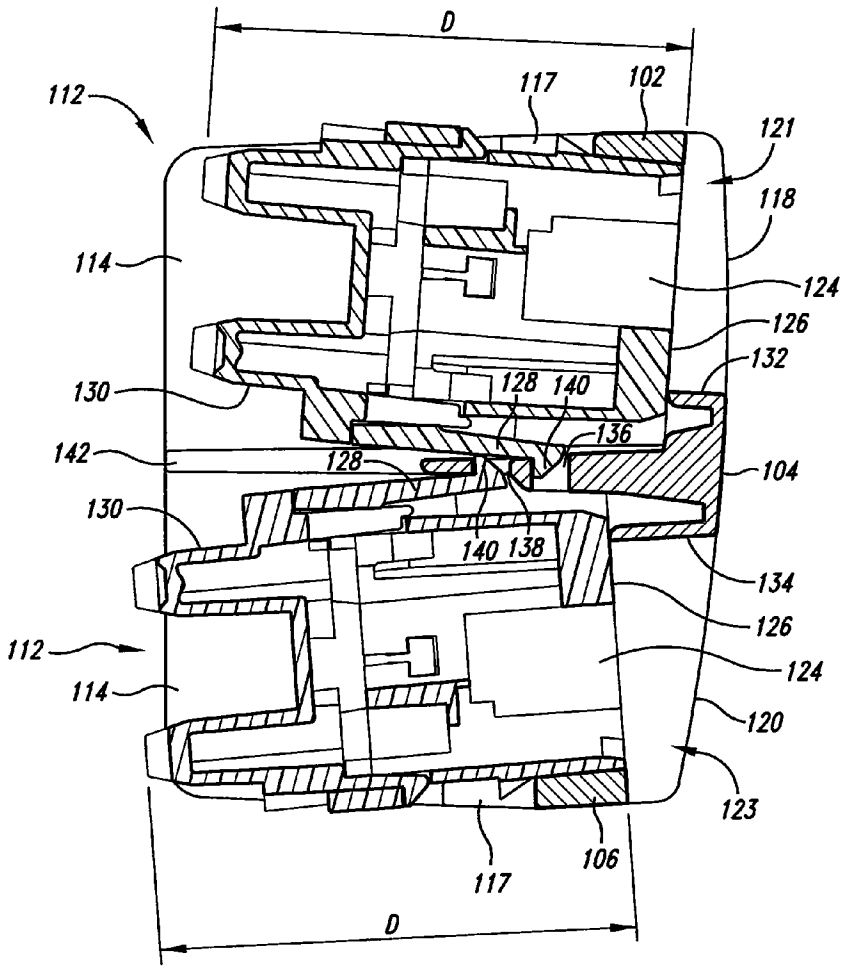
FIG. 5 is an enlarged cross-sectional view taken substantially along the line 5-5 of FIGS. 3 and 4 showing two connectors received by the station.

The first hold 136 receives the barb 140 and the first stop 132 helps to orient the incline of the connector 122 in the upper port 121, in position between the first longitudinal member 102 and the second longitudinal member 104, so as to provide the connector with a downward angled orientation, as shown in FIGS. 3-5. The second hold 138 receives the barb 140 and the second stop 134 helps to orient the incline of the connector 122 in the lower port 123, in position between the second longitudinal member 104 and the third longitudinal member 106, so as to provide the connector with an upward angled orientation. As shown in FIG. 5, the connectors 122 of each vertically aligned pair of upper and lower ports 121 and 123 (which are located between the same two adjacent shield members 112) are rotated 1800 with respect to the other so that the connector catches 128 of the connectors face toward each other. In other implementations, shield members, elongated members, and other structural members can be formed such that various other of the connectors 122 can be rotationally positioned in other desired orientations such as 0°, 90°, 180°, and 270° rotational orientations.

Figure 6:
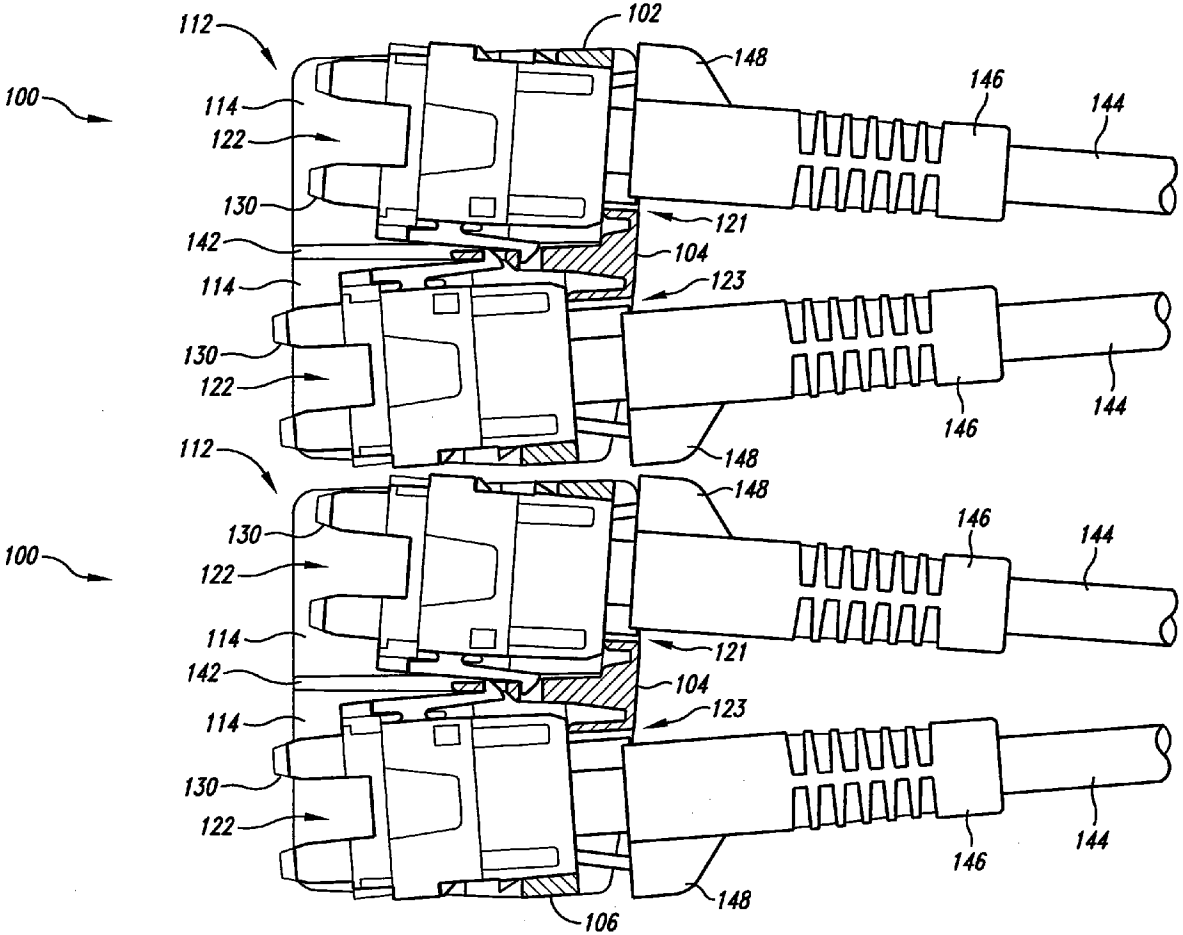
FIG. 6 is an enlarged side elevational cross-sectional view of two instances of the first implementation of FIG. 1 in close proximity to one another.
Figure 7:
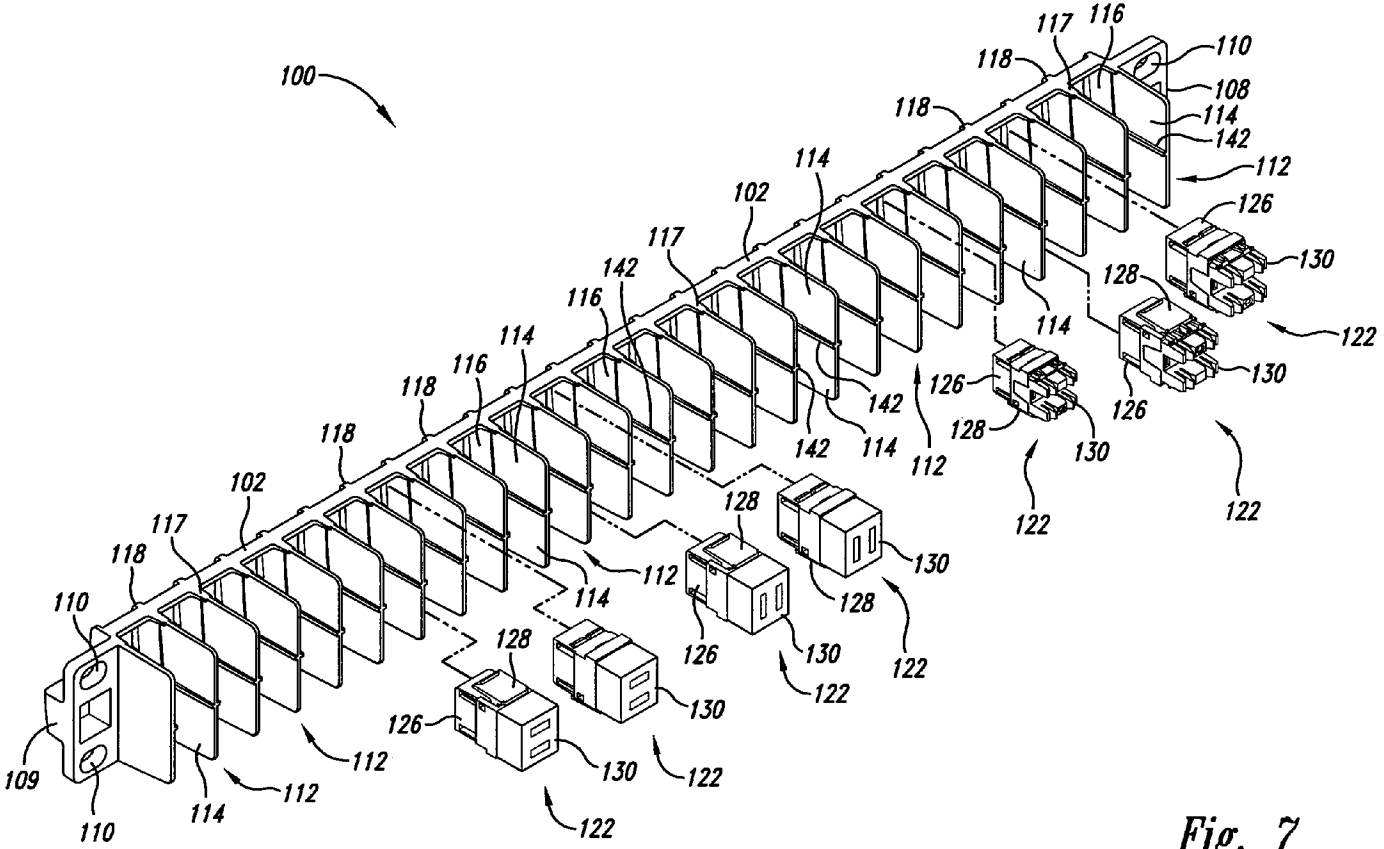
FIG. 7 is a rear isometric view of the first implementation of FIG. 1 and several connectors to be received by the station.
Figure 8:
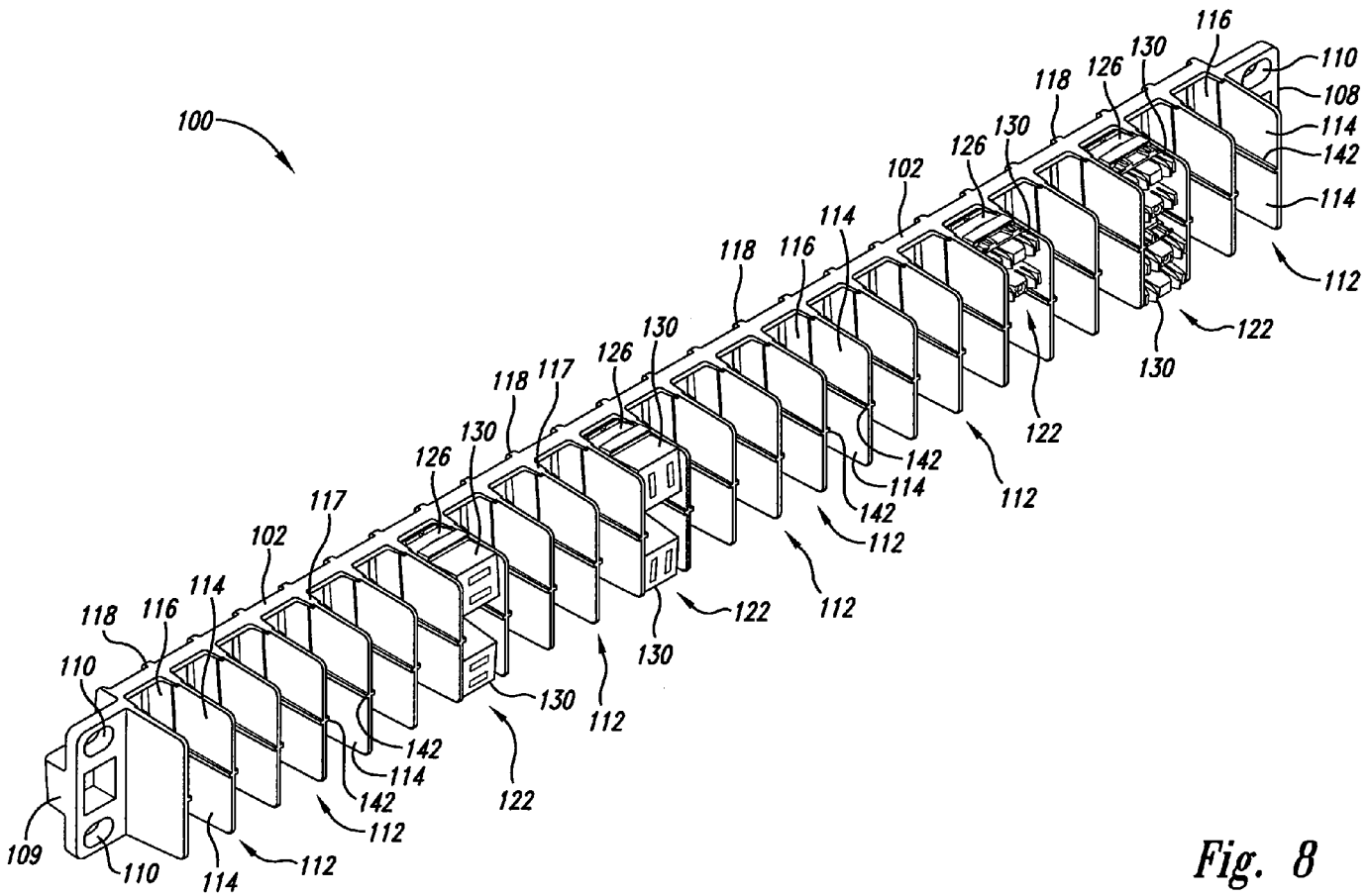
FIG. 8 is a rear isometric view of the first implementation of FIG. 1 with several connectors received by the station.

As best shown in FIG. 5, the connector 122 in the upper port 121 is forwardly offset from the connector 122 in the lower port 123 so that the connector catches 128 of the pair of connectors do not physically interfere with each other and allows the connectors to be vertically located closer together. This result is also facilitated by having the vertically aligned pairs of upper and lower ports 121 and 123 hold the connectors inserted therein at downward and upward angled orientations, respectively. The staggering or offsetting of connector insertions and difference in angled orientation of the connectors 122 of a vertically aligned pairs of upper and lower ports 121 and 123 allows for clearances between the catches 128 and attached cables. As shown in FIG. 6, the varying amounts of insertion and angled orientation of the connectors 122 allow for clearances between cable boots 146 and especially cable boot tabs 148. To help guide insertion of the connectors 122 into the ports 121 and 123, a rearward extending rib 142 projects laterally inward from the central portion of each adjacent pair of shield members 112 for a vertically aligned pairs of upper and lower ports 121 and 123, as best shown in FIGS. 7 and 8.

In the first implementation 100, the shield members 112 extend rearward substantially the entire depth, D, of the connectors 122 to provide a large degree of isolation. In other implementations, shield members may not extend rearward so far relative to the connectors, but also will not provide for as much isolation as the depicted implementation.

The second longitudinal member 104 does not extend rearward nearly as much of the depth, D, of the connectors 122 as do the shield members 112. The first longitudinal member 102 and the third longitudinal member 106 extend less of the depth, D, of the connectors 122 than does the second longitudinal member 104. This points out that the first implementation 100 and some, but not all, of the other implementations depicted, while providing some isolation between the connectors 122 of a vertically aligned pairs of upper and lower ports 121 and 123, the isolation provided is primarily between laterally adjacent ones of the connectors 122 in the same row of the upper and lower ports 121 and 123. In the first implementation 100, the distance between laterally adjacent connectors 122 in each of the upper and lower rows is smaller than the distance between the connectors in the vertically aligned pairs of upper and lower ports 121 and 123. Other configurations and orientations exist with other implementations such that the shielding members 112 may be used between the connectors in the vertically aligned pairs of upper and lower ports 121 and 123, or may be used between laterally adjacent connectors in the same row of the upper and lower ports 121 and 123 and also between the connectors in the vertically aligned pairs of upper and lower ports, thus providing shielding members along all sides of a connector extending along the depth, D, of the connectors, as discussed further below.

Figure 9:
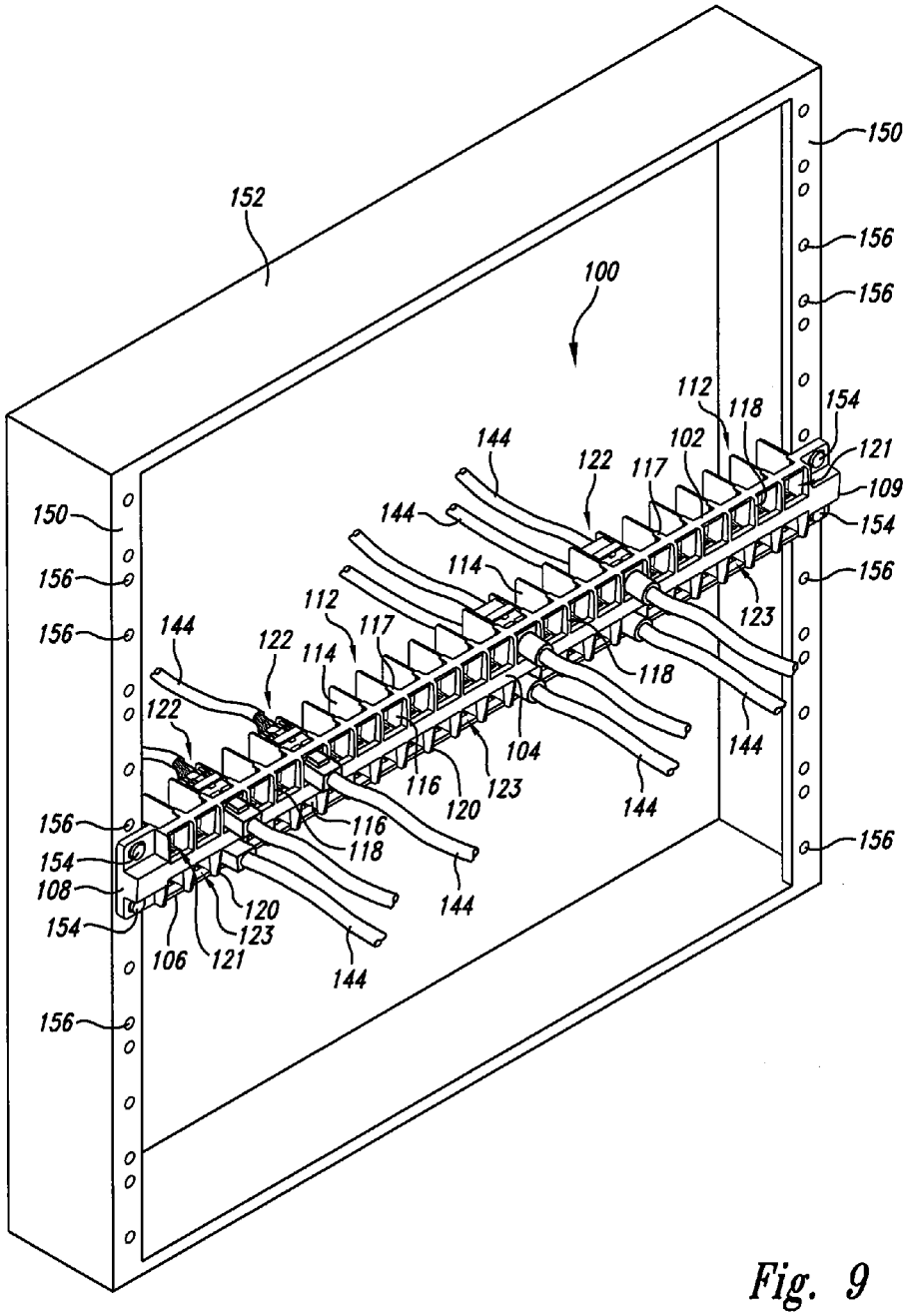
FIG. 9 is an isometric view of the first implementation of FIG. 1 mounted into a communications rack.

The first implementation 100 of the isolation connector station is shown in FIG. 9 as installed in a communication rack 152 using bolts 154 inserted through the holes 110 of the first implementation and holes 156 of the communication rack. Cables 144 are shown inserted into the connector receptacle portions 124 and coupled to the rear connector portions 130 of connectors 122 being retained by the first implementation 100.

Figure 10:
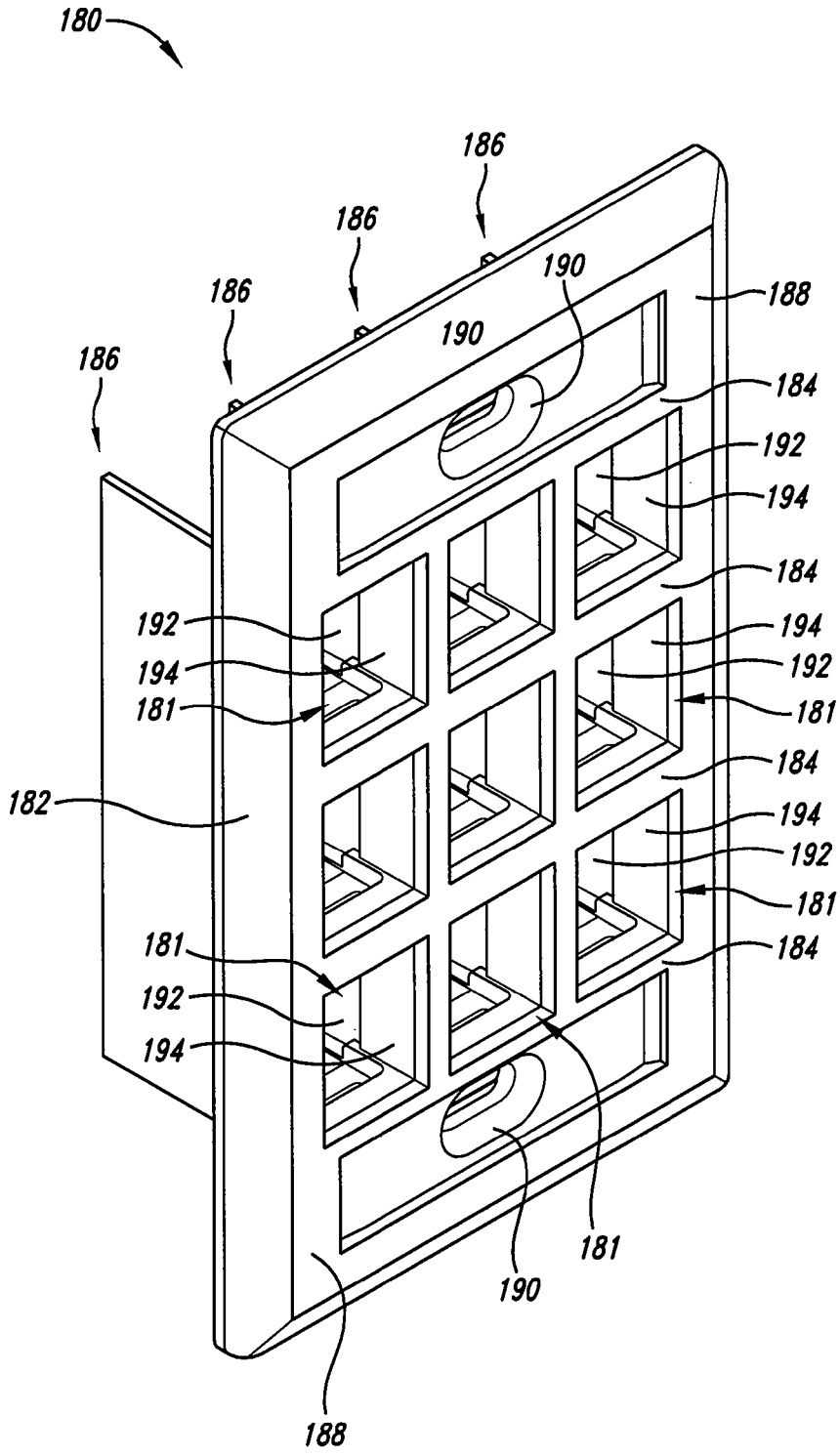
FIG. 10 is a front isometric view of a second implementation of the connector isolation station.

A second implementation 180 of the connector isolation station is shown in FIG. 10 as having a faceplate 182, longitudinal members 184, shield members 186 extending rearward from the faceplate, and bracket portions 188 with holes 190 for mounting purposes. Besides the second implementation 180 and the other depicted implementations as well, other arrangements of longitudinal members can be also used that do not have to necessarily rely on groupings of longitudinal members as illustrated. The second implementation 180 has three rows of three ports 181 each within which the connectors 122 may be positioned.

Figure 11:
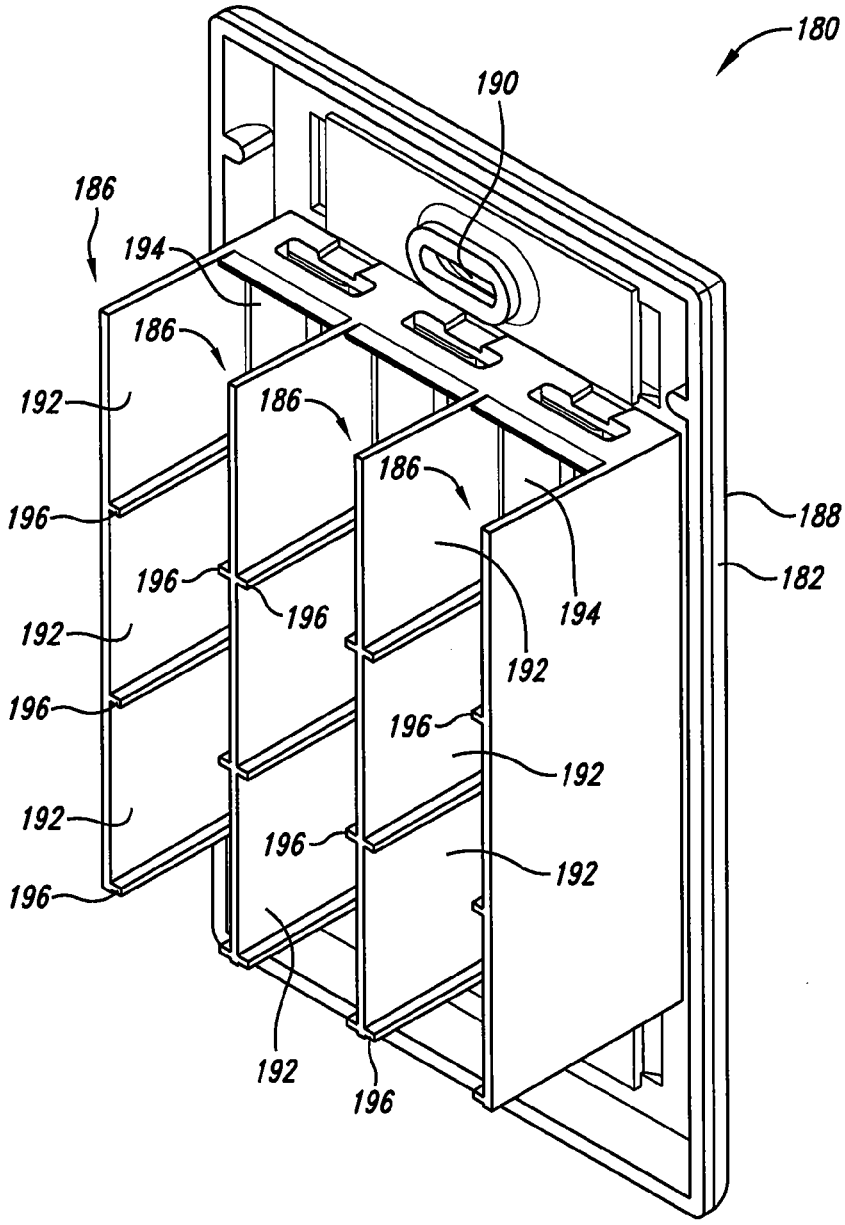
FIG. 11 is a rear isometric view of the second implementation of FIG. 10.
Figure 12:
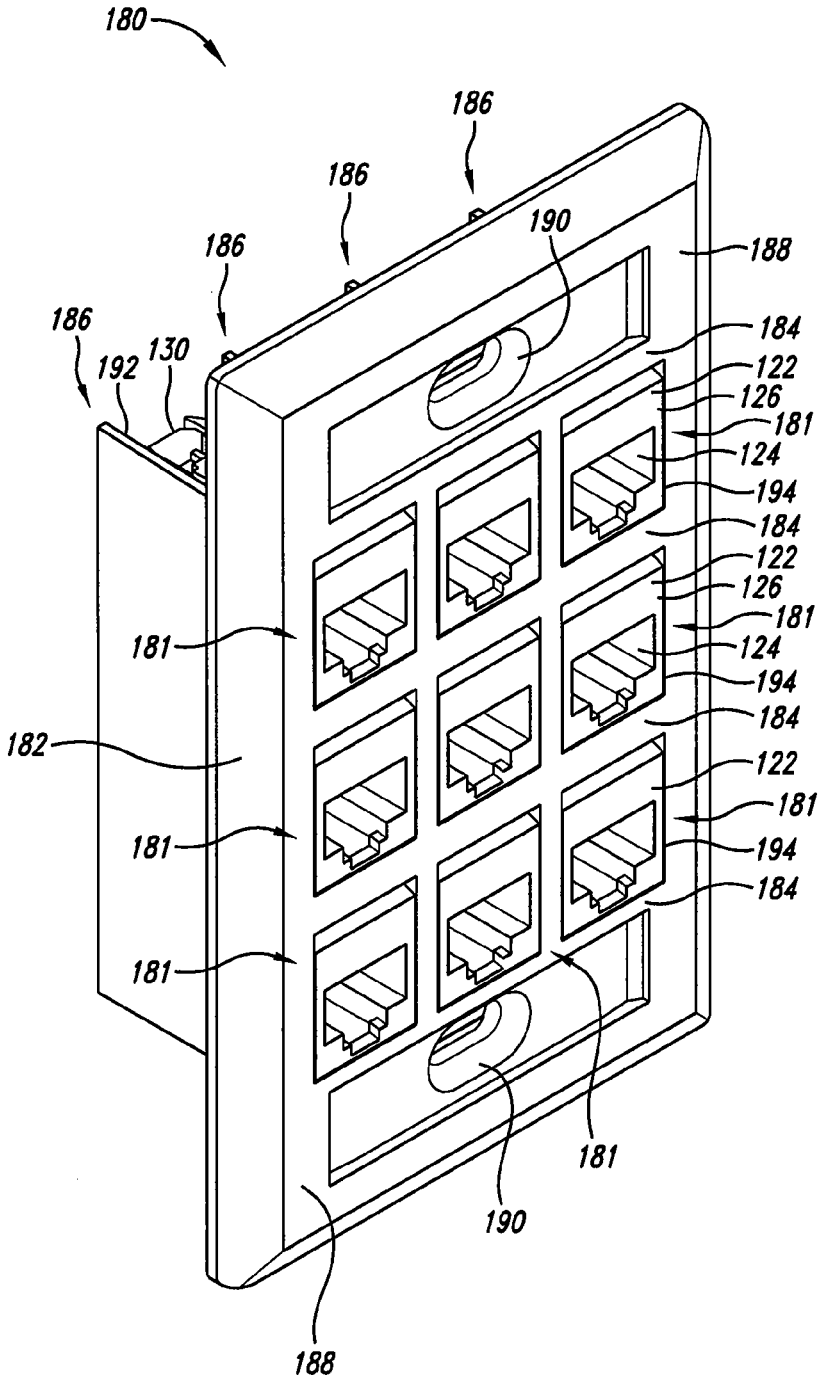
FIG. 12 is a front isometric view of the second implementation of FIG. 10 with connectors received by the station.
Figure 13:
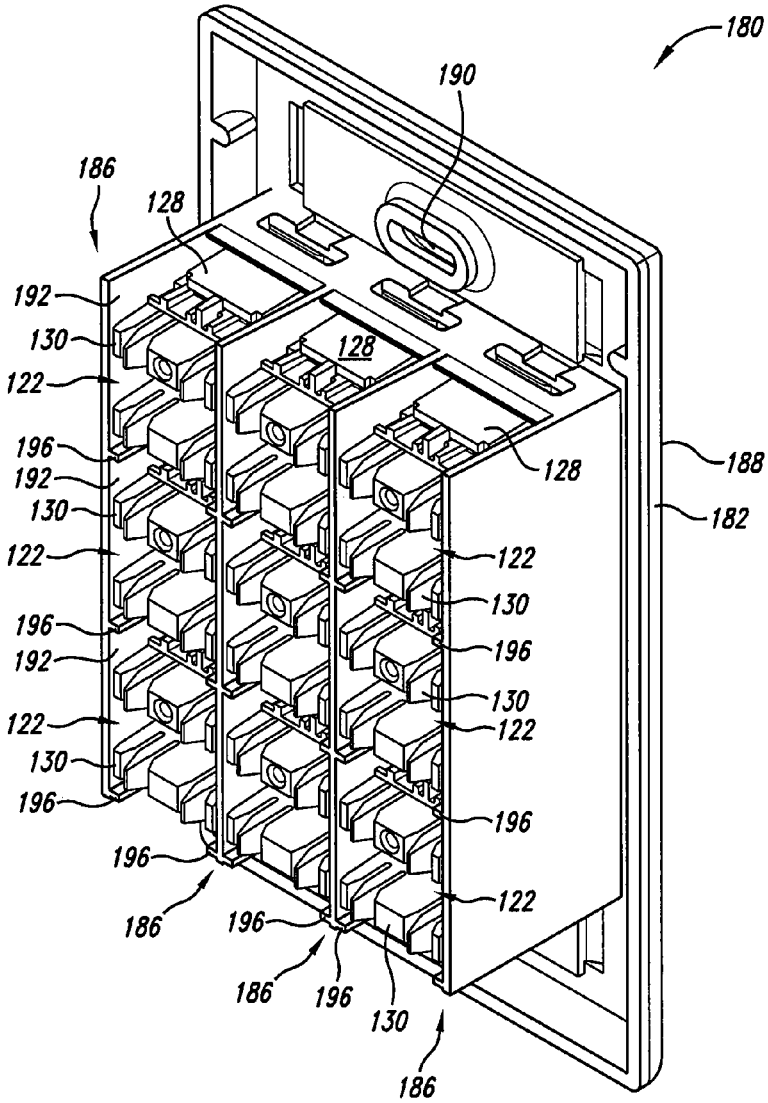
FIG. 13 is a rear isometric view of the second implementation shown in FIG. 10 with connectors received by the station.
Figure 14:
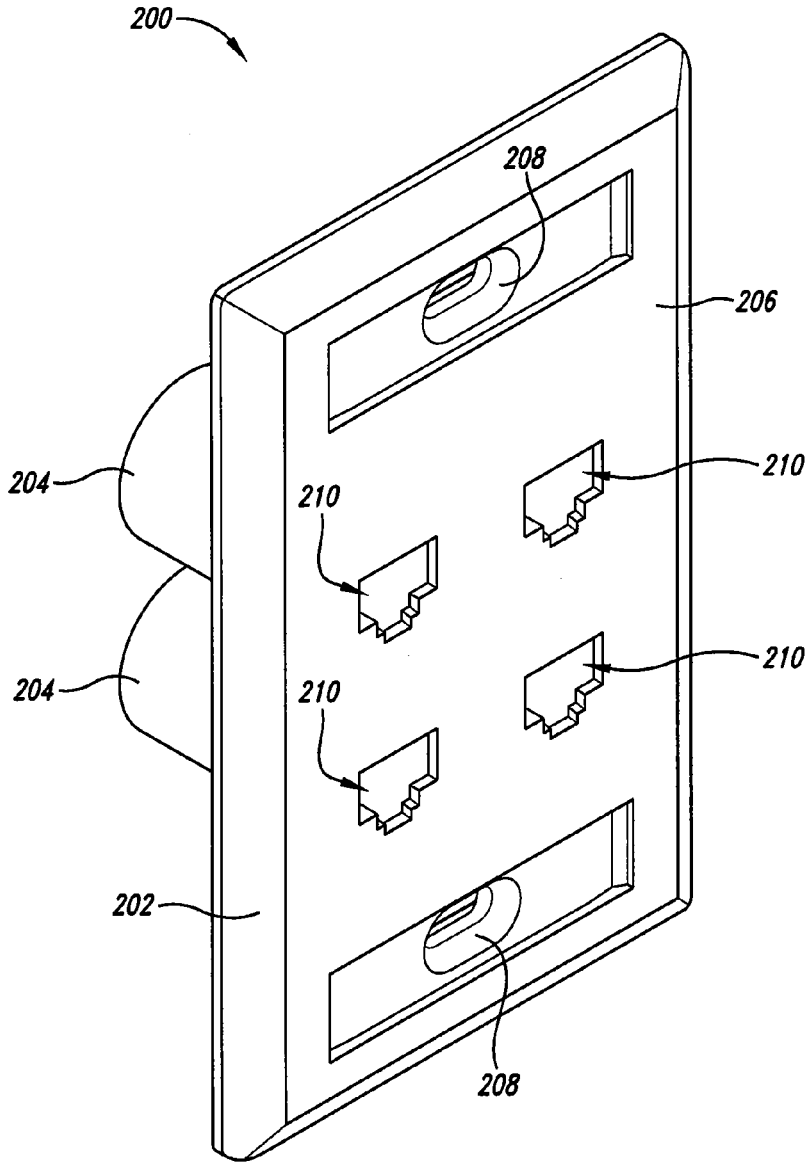
FIG. 14 is a front isometric view of a third implementation of the connector isolation station.
Figure 15:
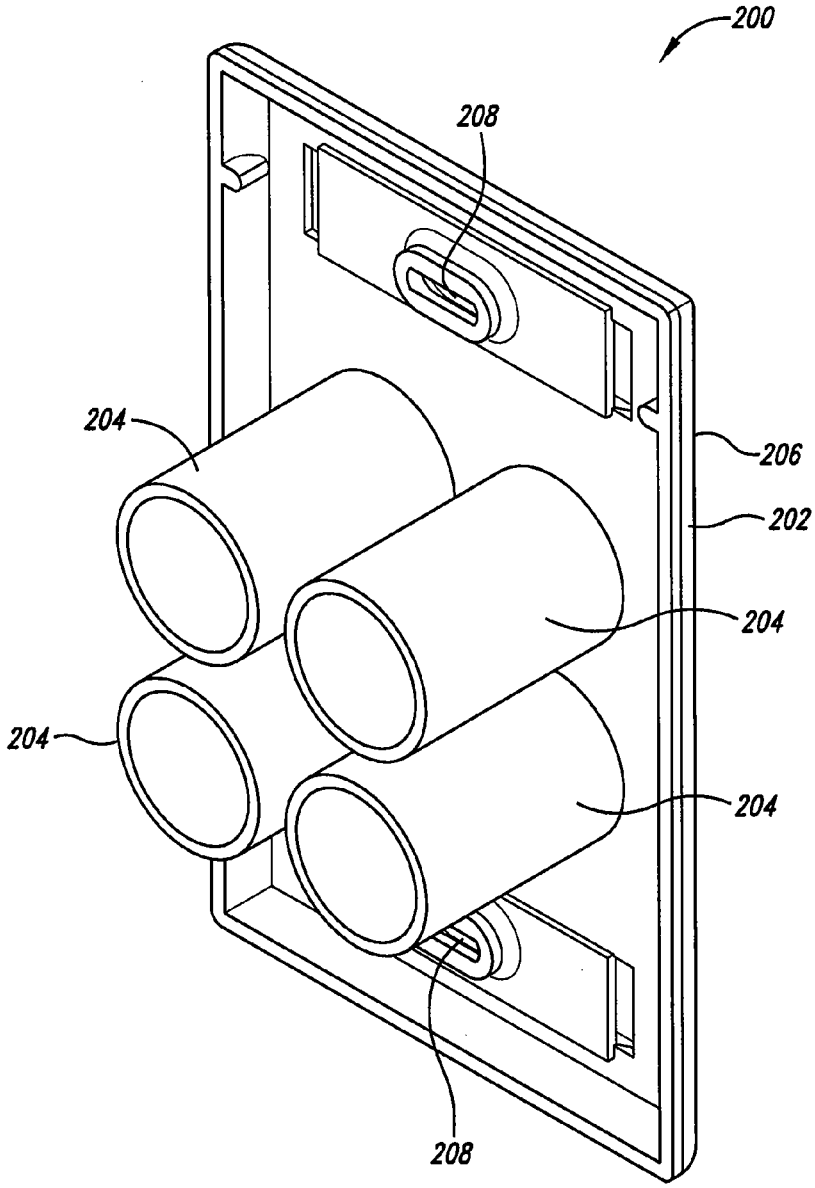
FIG. 15 is a rear isometric view of the third implementation of FIG. 14.
Figure 16:
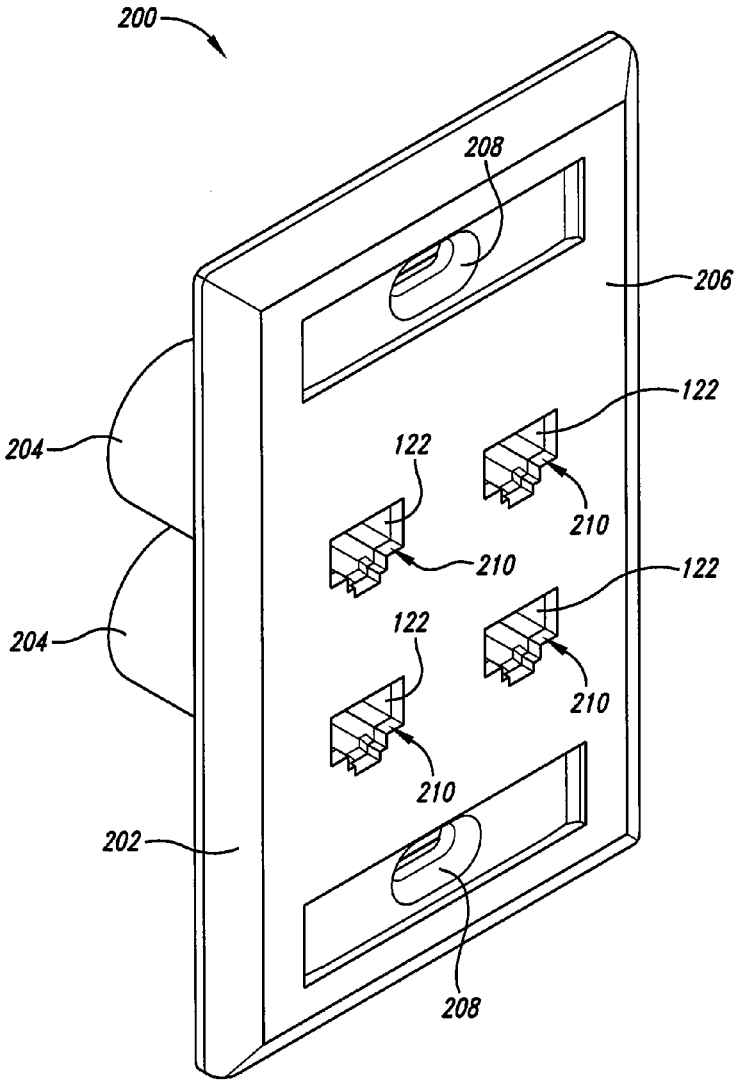
FIG. 16 is a front isometric view of the third implementation of FIG. 14 with connectors received by the station.
Figure 17:
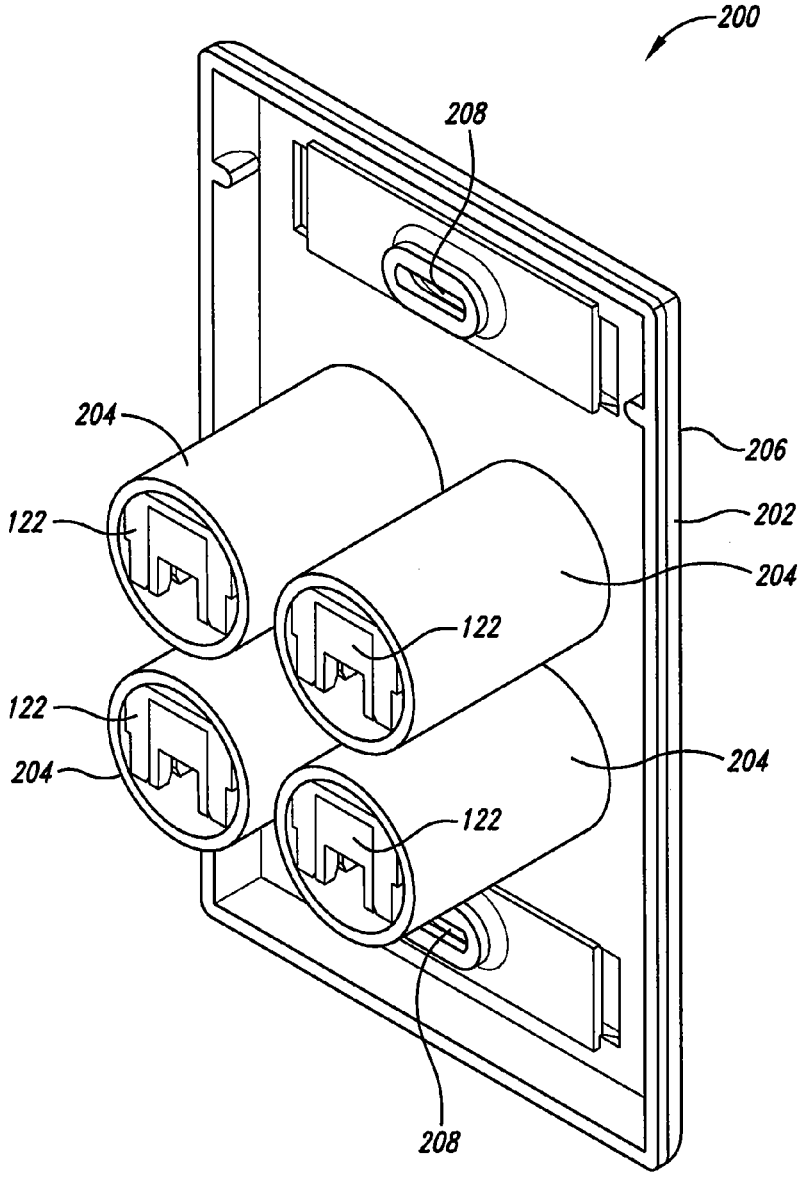
FIG. 17 is a rear isometric view of the third implementation shown in FIG. 14 with connectors received by the station.

The shield members 186 include rear shield portions 192 and front shield portions 194, similar to those of the shield members 112. The rear shield portions 192 of the shield members 186 extend from and are attached to the corresponding front shield portions 194. The second implementation 180 can be mounted on a wall of a room to provide functionality of a wall outlet. As shown in FIG. 11, the shield members 186 include rearward extending ribs 196 projecting laterally inward from the central portion of each adjacent pair of shield members 186 to help guide insertion of the connectors 122 into the ports 181. Exemplary versions of the connectors 122 are shown in FIGS. 12 and 13 inserted into the ports 181 of the second implementation.

A third implementation 200 of the connector isolation station is shown in FIGS. 14-17 as having a faceplate 202, shield members 204, a bracket portion 206 with holes 208 for mounting, and connector receptacles or ports 210. The third implementation 200 has two rows of two ports 210 each within which the connectors 122 may be positioned. As illustrated, the ports 210 are specially shaped to receive particular versions of the connectors 122. In the third implementation 200, the shield members 204 are shown as being curvilinearly shaped, in particular tubular, thereby providing further illustration that other implementations can use variously shaped shield members while still similarly accomplishing the intent and scope of the depicted implementations.

Figure 18:
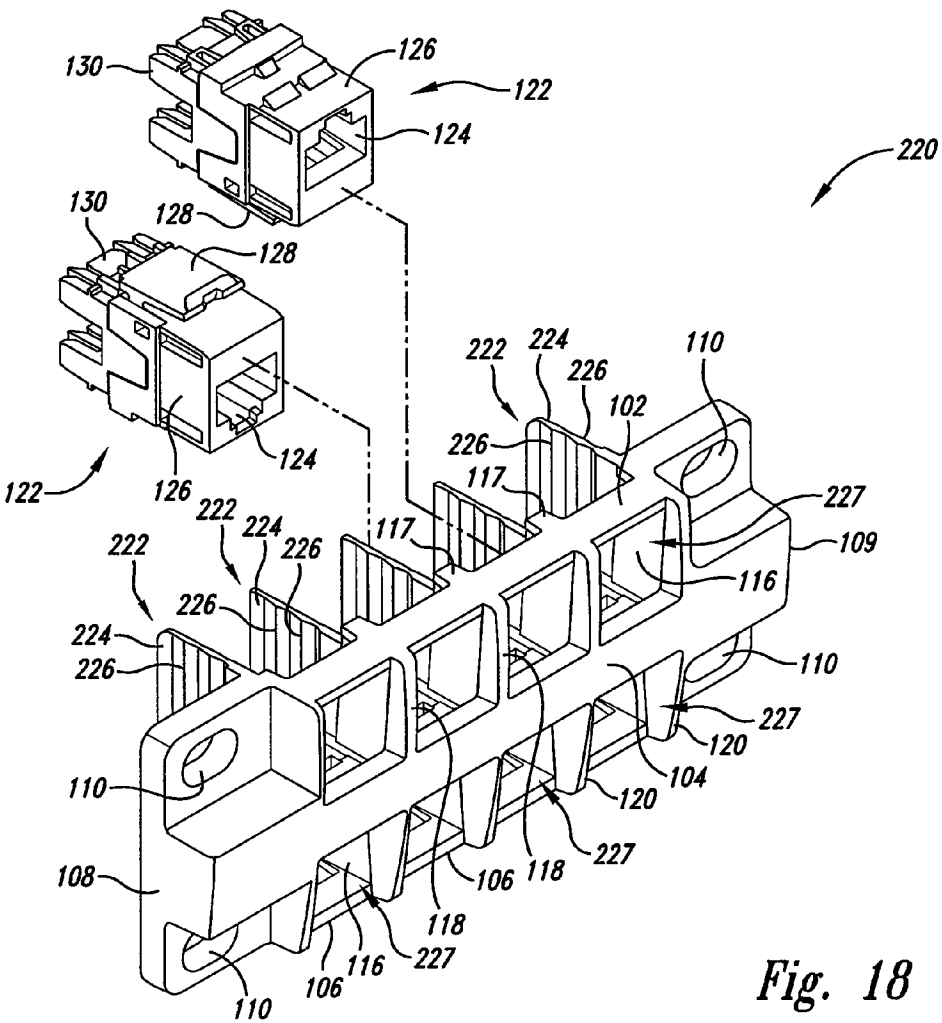
FIG. 18 is a front isometric view of a fourth implementation of the connector isolation station and several connectors to be received by the station.
Figure 19:
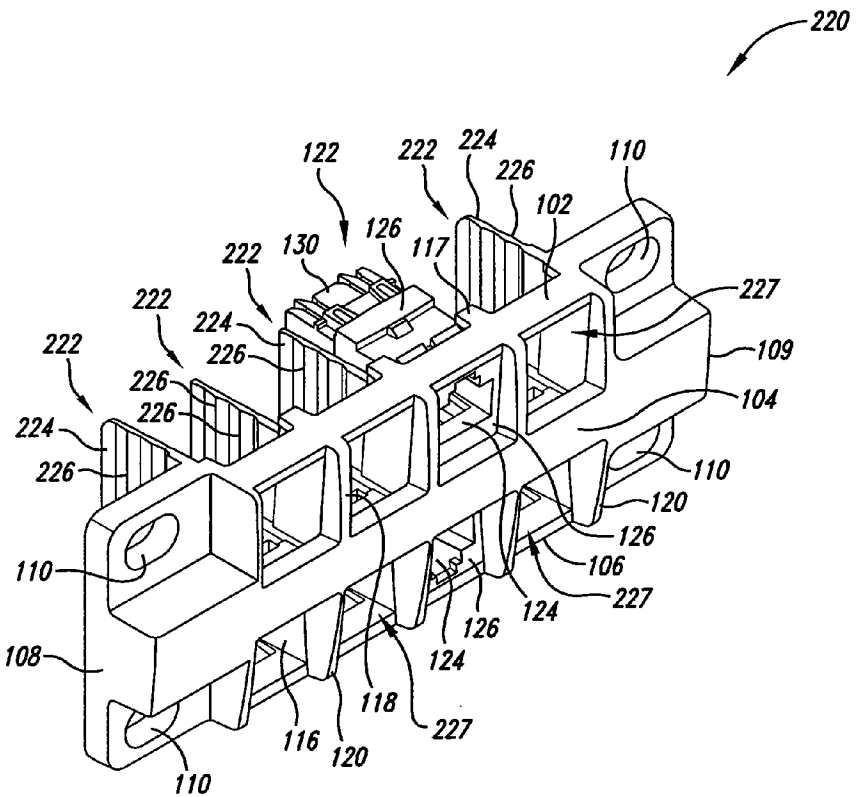
FIG. 19 is a front isometric view of the fourth implementation of FIG. 18 shown with connectors received by the station.

A fourth implementation 220 of the connector isolation station is shown in FIGS. 18-19 as having shield members 222 with rear shield portions 224 having ribs 226. The fourth implementation 220 has two rows of four ports 227 each within which the connectors 122 may be positioned, and is configured to be rack mounted or otherwise mounted. The various depicted implementations show that the number of the connectors 122 involved can vary without affecting the general approach of isolation. The shield members 222 are another example of how various implementations can differ as to how the shield members are configured for isolation of the connectors 112.

Figure 20:
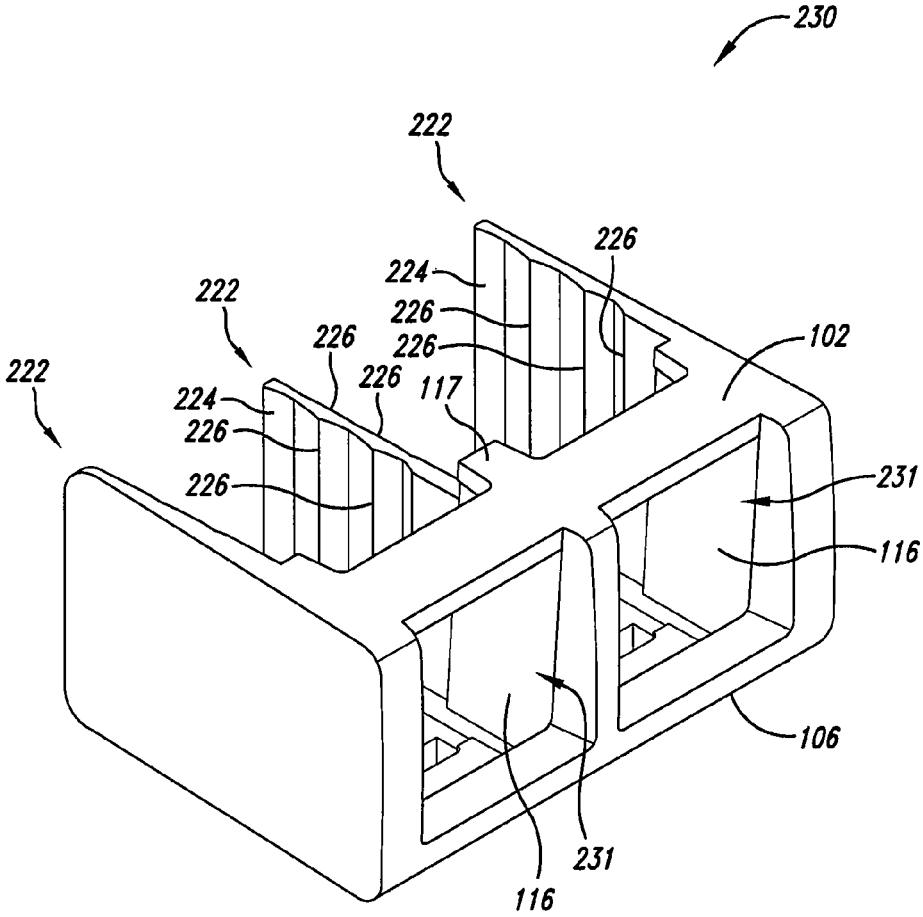
FIG. 20 is a front isometric view of a fifth implementation of the connector isolation station.

A fifth implementation 230 of the connector isolation station is shown in FIG. 20 with a single row of two ports 231, each within which the connectors 122 may be positioned, and is configured as a modular unit.

Figure 21:
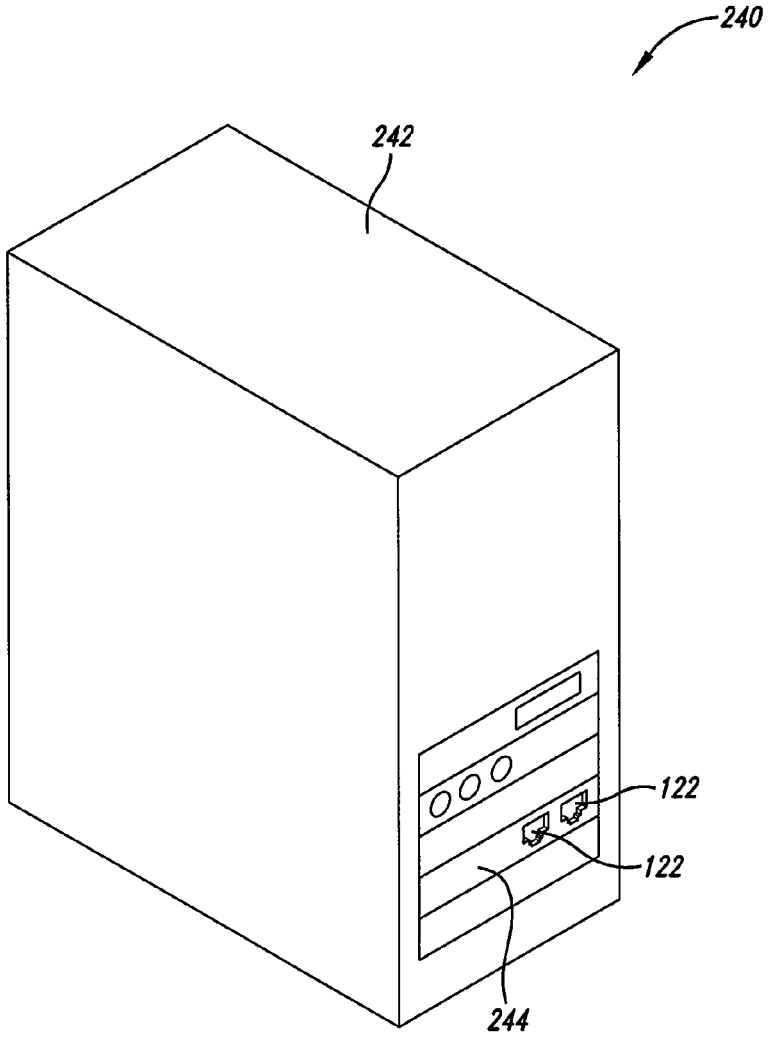
FIG. 21 is a front isometric view of a sixth implementation of the connector isolation station.

A sixth implementation 240 of the connector isolation station is shown in FIG. 21 to include a workstation computer 242 along with a computer faceplate 244. The sixth implementation 240 has shield members (not shown) to isolate the connectors 122 from each other and also to isolate other interference produced by other electronic components within the workstation computer 242.

Figure 22:
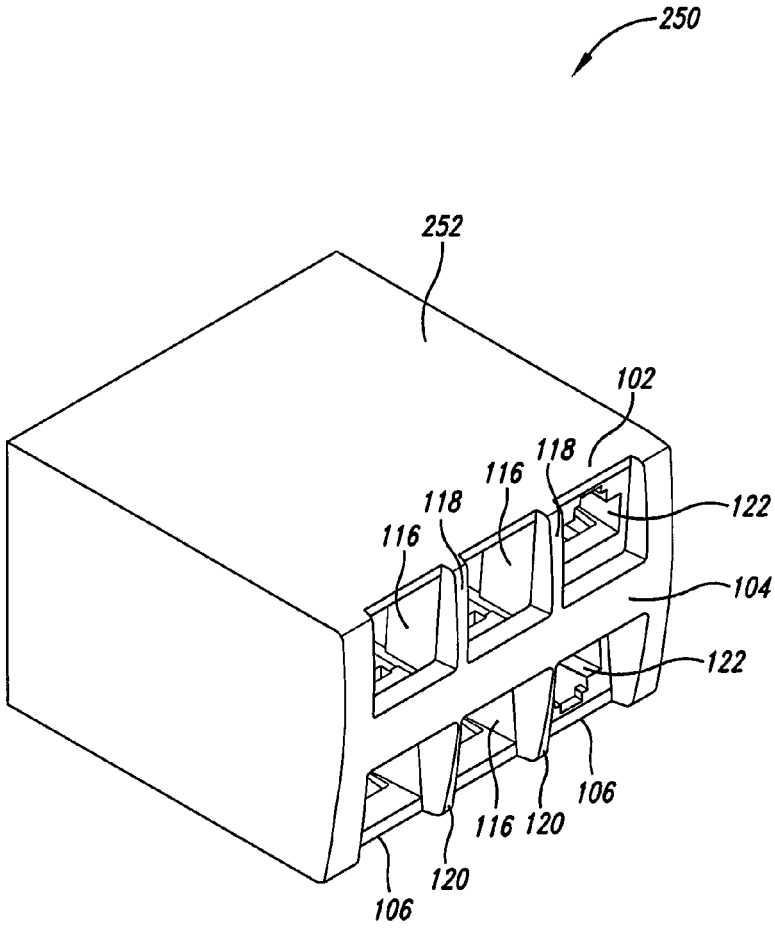
FIG. 22 is a front isometric view of a seventh implementation of the connector isolation station.

A seventh implementation 250 of the connector isolation station is shown in FIG. 22 as a stand-alone modular unit having a separate housing 252. The seventh implementation 250 can be configured as a wired or wireless unit.

Figure 23:
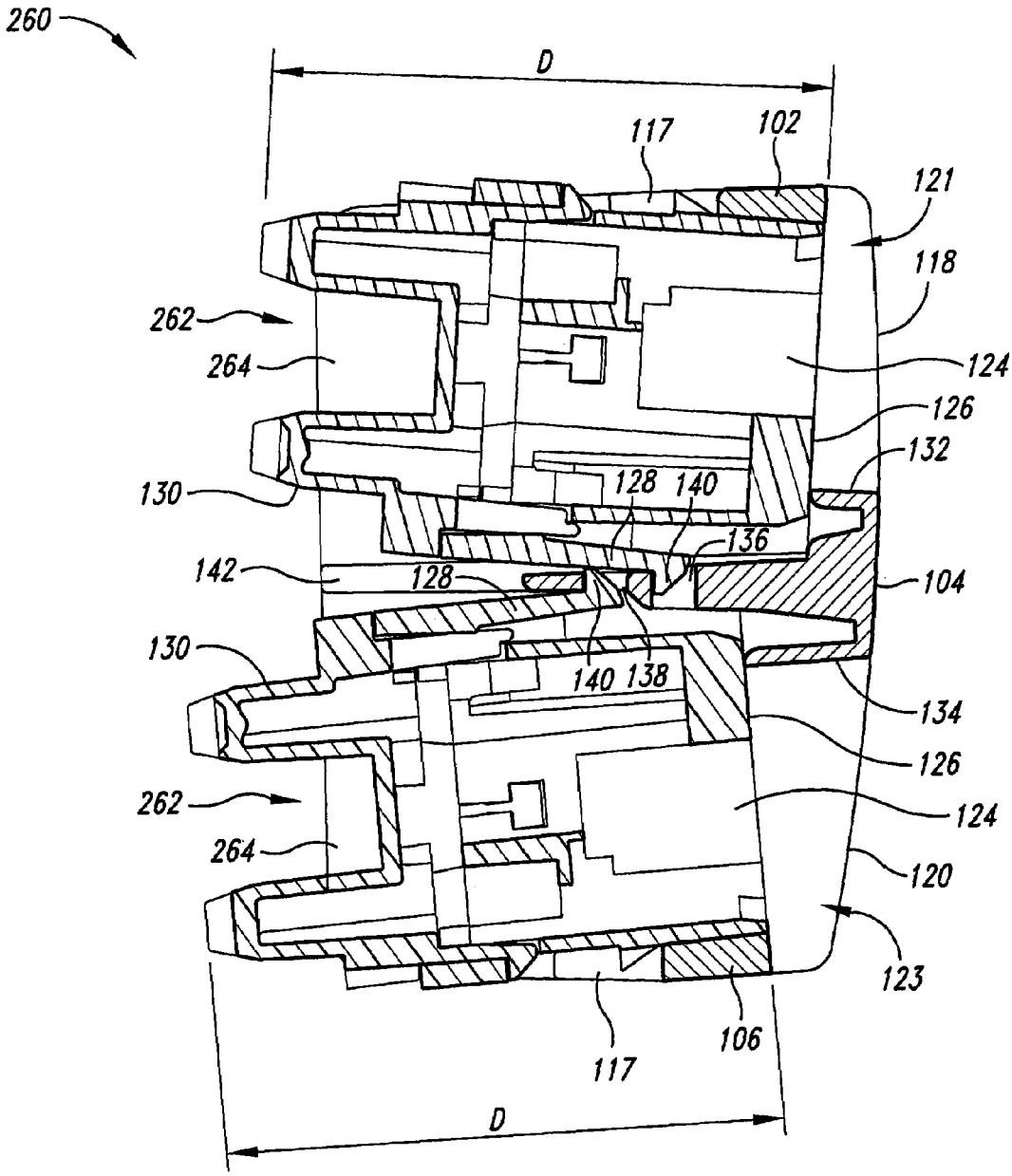
FIG. 23 is side elevational view cross-sectional view of an eighth implementation of the connector isolation station.

An eighth implementation 260 of the connector isolation station is shown in FIG. 23 and is similar to the first implementation 100. However, the eighth implementation 260 has shield members 262 with rear shield portions 264 that do not extend as far as the rear shield portions 114 of the shield members 112 of the first implementation 100. The degree of extension of the shield members 262 is dependent in part on how close the various connectors 122 are placed together and to a certain extent as to how the various connectors are shaped.

Figure 24:
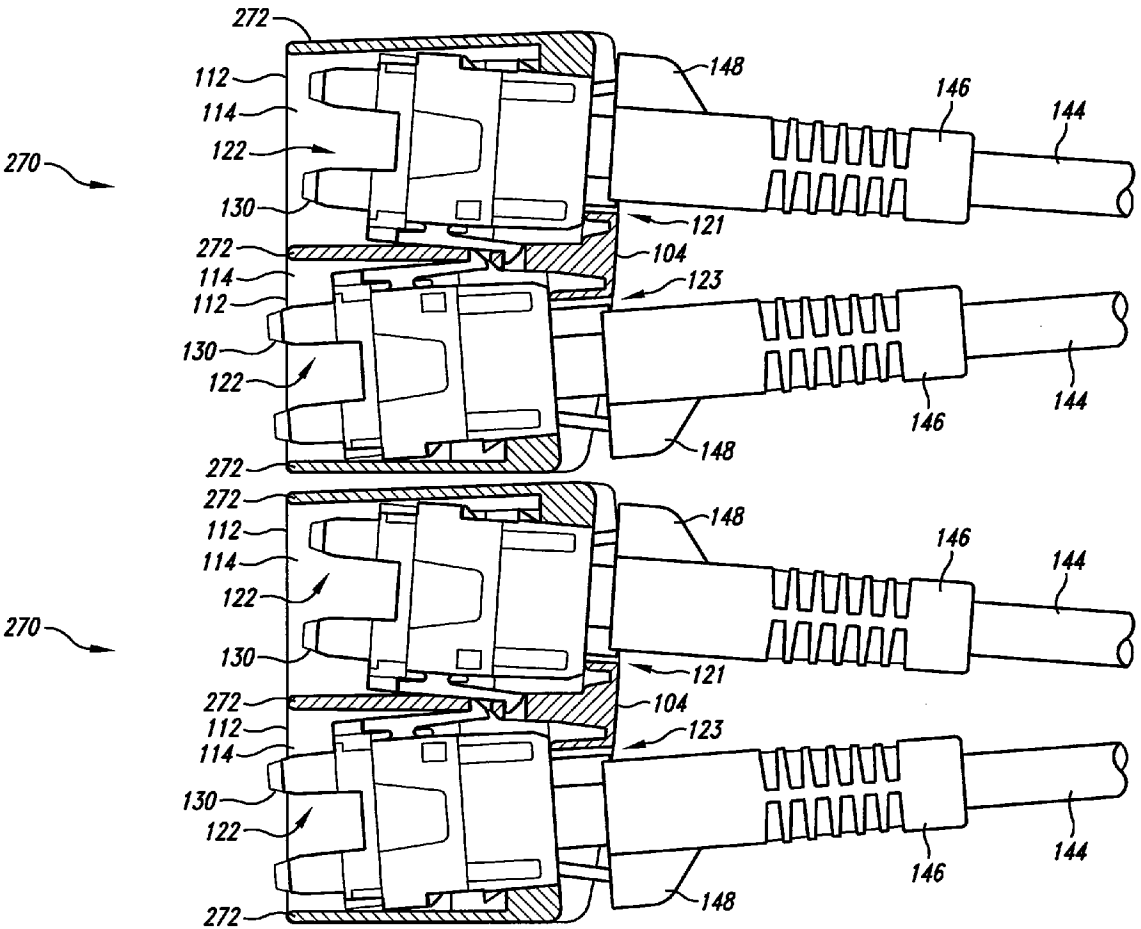
FIG. 24 is an enlarged side elevational cross-sectional view of two instances of a ninth implementation in close proximity to one another.

Two instances of a ninth implementation 270 are shown in FIG. 24 in close proximity to one another. Each instance of the ninth implementation 270 has horizontally oriented shield members 272 on peripheral portions to block interference from adjacent instances of the ninth implementation 270.

Figure 25:
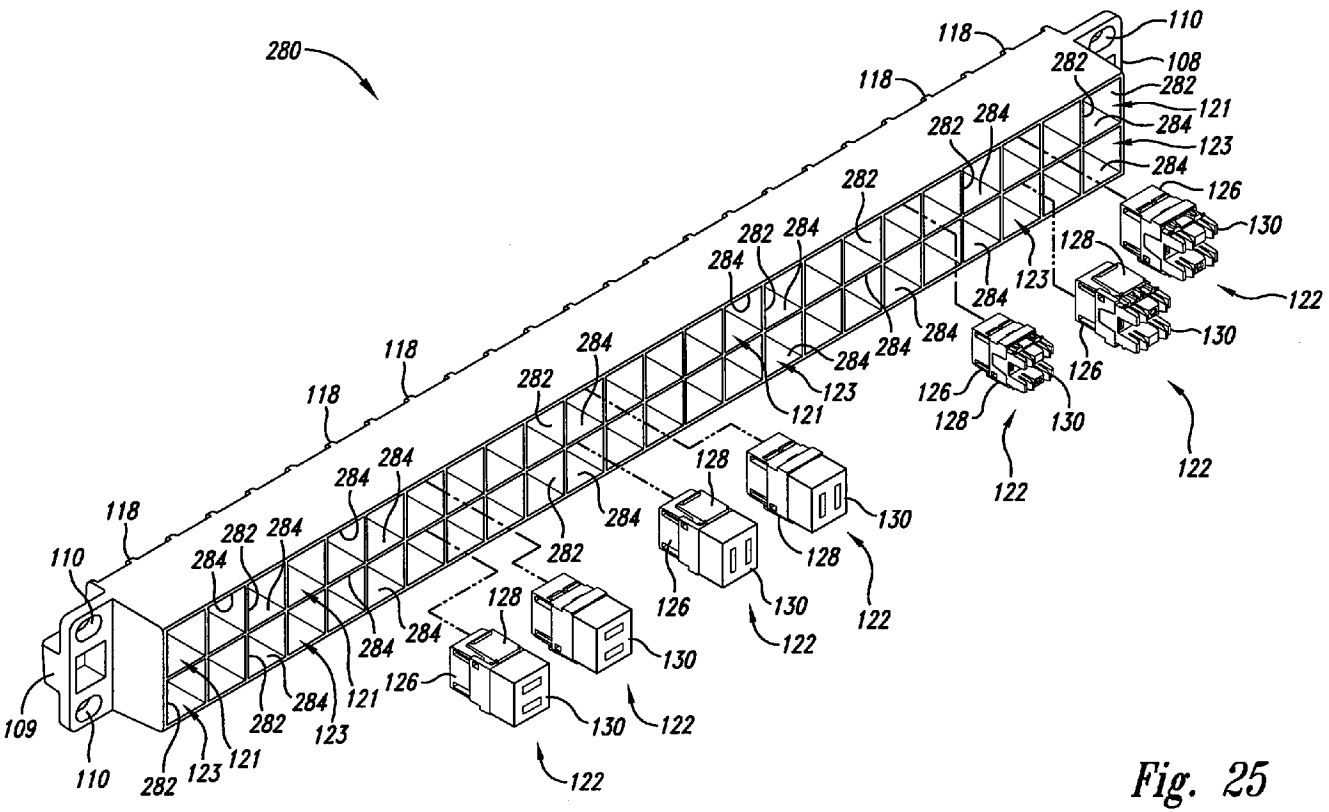
FIG. 25 is a front isometric view of a tenth implementation of the connector isolation station with several connectors to be received by the station.
Figure 26:
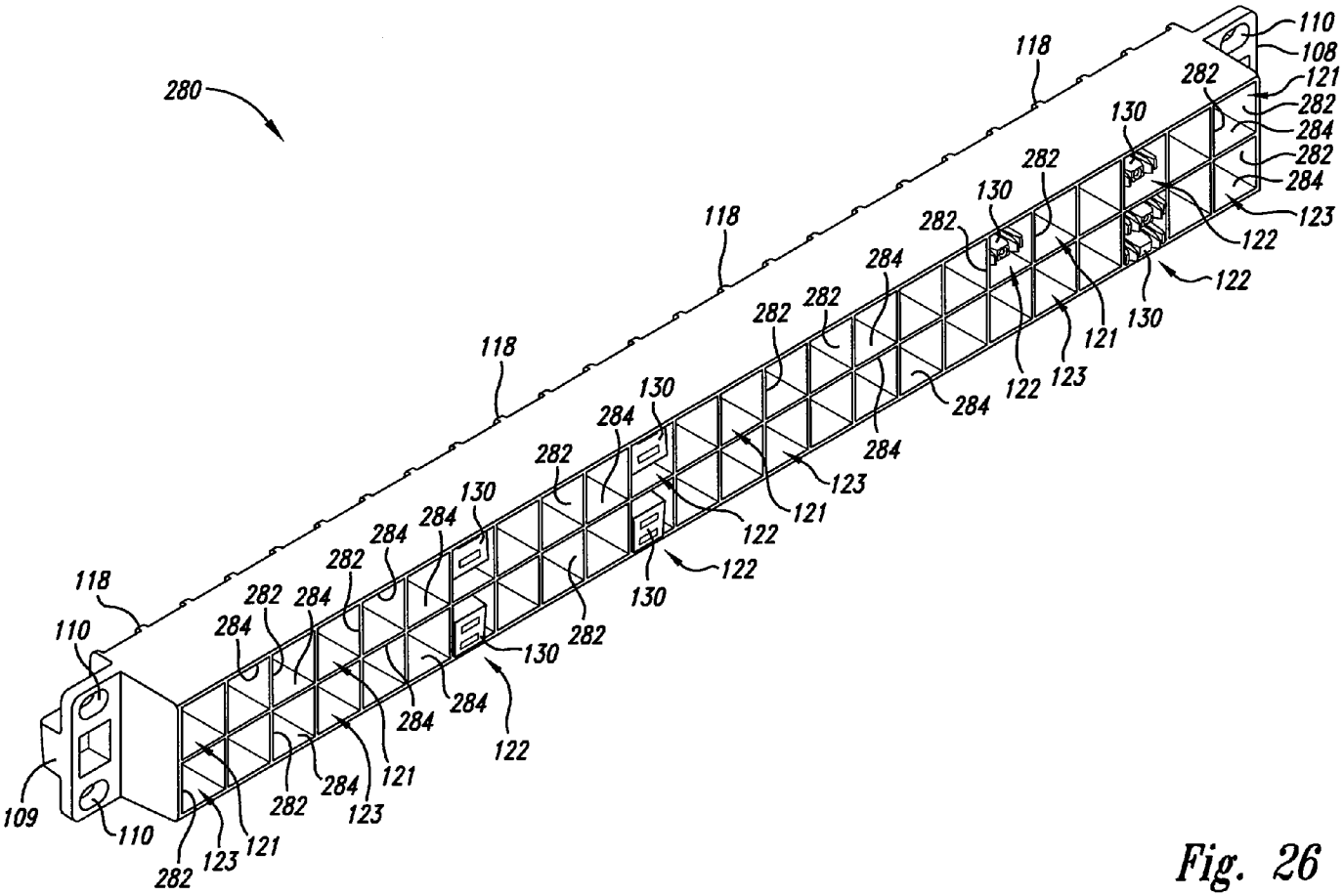
FIG. 26 is a front isometric view of the tenth implementation of FIG. 25 with several connectors received by the station.

A tenth implementation 280 is shown in FIGS. 25 and 26 as having both vertically oriented shield members 282 and horizontally oriented shield members 284 for each of the upper ports 121 and the lower ports 123.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A system for a plurality of connectors each having a dimensional depth, the system comprising:

a first longitudinal member;

a second longitudinal member;

a third longitudinal member, the second longitudinal member being positioned between the first and third longitudinal members and spaced from each of the first and third longitudinal members;

a plurality of upper ports arranged in an upper row of ports, each upper port positioned to have one of the plurality of connectors mounted adjacent thereto for access to the connector;

a plurality of lower ports arranged in a lower row of ports, each lower port positioned to have one of the plurality of connectors mounted adjacent thereto for access to the connector; and a plurality of shield members extending rearward from the first longitudinal member, the second longitudinal member and the third longitudinal member, and support by at least one of the first, second and third longitudinal members, adjacent ones of the plurality of shield members having one of the upper ports of the upper row of ports therebetween and one of the lower ports of the lower row of ports therebetween, and being spaced apart sufficient for receiving therebetween one of the plurality of connectors at the upper port therebetween and one of the plurality of connectors at the lower port therebetween, the shield members including electrically conductive material.

2. The system of claim 1 wherein the adjacent ones of the plurality of shield members are sized to extend along the dimensional depth of the ones of the plurality of connectors received therebetween.

3. The system of claim 1 wherein the upper row of ports are positioned above the second longitudinal member and the lower row of ports are positioned below the second longitudinal member.

4. The system of claim 1, further including positioned between the adjacent ones of the plurality of shield members a first mounting portion at the upper port configured to mount one of the connectors of the plurality of connectors therebetween and a second mounting portion at the lower port configured to mount one of the connectors of the plurality of connectors therebetween.

5. The system of claim 2 wherein the first mounting portion is configured to position the connector mounted thereby at a downward angled orientation and the second mounting portion is configured to position the connector mounted thereby at an upward angled orientation.

6. The system of claim 4 wherein one of the first mounting portion and the second mounting portion is positioned rearward of the other to mount the connector mounted thereby rearward displaced from the connector mounted by the other of first mounting portion and the second mounting portion.

7. The system of claim 2 wherein the first and third longitudinal members are arranged transverse to the second longitudinal member.

8. A connector mounting system comprising:

a first plurality of connectors;

a second plurality of connectors;

a plurality of first ports arranged in a first line of ports, each first port positioned to have one of the first plurality of connectors mounted adjacent thereto;

a plurality of second ports arranged in a second line of ports, each second port positioned to have one of the second plurality of connectors mounted adjacent thereto;

a first longitudinal member;

a second longitudinal member, the second longitudinal member including a plurality of first mounting portions and a plurality of second mounting portions, each first mounting portion being configured to mount one of the first plurality of connectors adjacent to a different one of the plurality of first ports and each second mounting portion being configured to mount one of the second plurality of connectors adjacent to a different one of the plurality of second ports;

a third longitudinal member, the second longitudinal member being positioned between the first and third longitudinal members and spaced from each of the first and third longitudinal members; and a plurality of shield members extending away from the first longitudinal member, the second longitudinal member and the third longitudinal member, and supported by at least one of the first, second and third longitudinal members, adjacent ones of the plurality of shield members having one of the plurality of first mounting portions and one of the plurality of second mounting portions therebetween, and having one of the plurality of first ports and one of the plurality of second ports therebetween, the adjacent ones of the plurality of shield members being spaced apart sufficient for receiving therebetween one of the first plurality of connectors for mounting by the one of the plurality of first mounting portions at the one of the plurality of first ports therebetween and one of the second plurality of connectors for mounting by the one of the plurality of second mounting portions at the one of the plurality of second ports therebetween, the shield members including electrically conductive material.

9. The system of claim 8 wherein the ports of the first line of ports are arranged in adjacent pairs with the ports of the second line of ports.

10. The system of claim 8 wherein the first line of ports is positioned to one side of the second longitudinal member and the second line of ports is positioned to an opposite side of the second longitudinal member.

11. The system of claim 8 wherein each of the first and second plurality of connectors has a dimensional depth, and the plurality of shield members extend along substantially the full dimensional depth of the ones of the first and second plurality of connectors received therebetween.

12. The system of claim 8 wherein the first mounting portion is configured to position the connector of the first plurality of connectors mounted thereby at a first angled orientation and the second mounting portion is configured to position the connector of the second plurality of connectors mounted thereby at a second angled orientation not in alignment with the first angled orientation.

13. The system of claim 8 wherein one of the first mounting portion and the second mounting portion positioned between adjacent ones of the plurality of shield members is positioned space from the other to mount the connector mounted thereby displaced from the connector mounted by the other of first mounting portion and the second mounting portion.

14. The system of claim 8 wherein the first and third longitudinal members are arranged transverse to the second longitudinal member.

15. A connector mounting system comprising:

a first plurality of connectors;

a second plurality of connectors;

a first longitudinal member;

a second longitudinal member including a plurality of first mounting portions and a plurality of second mounting portions, each first mounting portion being configured to mount one of the first plurality of connectors and each second mounting portion being configured to mount one of the second plurality of connectors;

a third longitudinal member, the second longitudinal member being positioned between the first and third longitudinal members and spaced from each of the first and third longitudinal members; and a first plurality of shield members supported by at least one of the first, second and third longitudinal members, adjacent ones of the first plurality of shield members having one of the plurality of first mounting portions therebetween, the adjacent ones of the first plurality of shield members being spaced apart sufficient for receiving therebetween one of the first plurality of connectors for mounting by the one of the plurality of first mounting portions therebetween, the first plurality of shield members including electrically conductive material;

a second plurality of shield members supported by at least one of the first, second and third longitudinal members, adjacent ones of the second plurality of shield members having one of the plurality of second mounting portions therebetween, the adjacent ones of the second plurality of shield members being spaced apart sufficient for receiving therebetween one of the second plurality of connectors for mounting by the one of the plurality of second mounting portions therebetween, the second plurality of shield members including electrically conductive material.

16. The system of claim 15 wherein the first mounting portions of the plurality of first mounting portions are arranged in a first line and the second mounting portions of the plurality of second mounting portions are arranged in a second line adjacent to the first line, with the first mounting portions and the second mounting portions arranged in adjacent pairs.

17. The system of claim 16 wherein the first line of first mounting portions is positioned to one side of the second longitudinal member and the second line of second mounting portions ports is positioned to an opposite side of the second longitudinal member.

18. The system of claim 15 wherein each of the first and second plurality of connectors has a dimensional depth, and the first and second pluralities of shield members extend along substantially the full dimensional depth of the ones of the first and second plurality of connectors received therebetween.

19. The system of claim 15 wherein the first mounting portion is configured to position the connector of the first plurality of connectors mounted thereby at a first angled orientation and the second mounting portion is configured to position the connector of the second plurality of connectors mounted thereby at a second angled orientation not in alignment with the first angled orientation.

20. The system of claim 15 wherein the first and second pluralities of shield members are arranged with each one of the first plurality of shield members is in substantial coplanar alignment with a different one of the second plurality of shield members.

21. The system of claim 15 wherein one of the plurality of first mounting portions and the plurality of second mounting portions positioned are positioned space from the other to mount the connectors mounted thereby displaced from the connectors mounted by the other of first mounting portion and the second mounting portion.

* * * * *